US009091041B2

(12) United States Patent
Yoshida et al.

(10) Patent No.: US 9,091,041 B2
(45) Date of Patent: Jul. 28, 2015

(54) CONSTRUCTION MACHINE

(71) Applicant: HITACHI CONSTRUCTION MACHINERY CO., LTD., Tokyo (JP)

(72) Inventors: Hajime Yoshida, Omihachiman (JP); Shuuhei Noguchi, Higashiomi (JP); Makoto Motozu, Moriyama (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 14/362,415

(22) PCT Filed: Jan. 9, 2013

(86) PCT No.: PCT/JP2013/050185
§ 371 (c)(1),
(2) Date: Jun. 3, 2014

(87) PCT Pub. No.: WO2013/111613
PCT Pub. Date: Aug. 1, 2013

(65) Prior Publication Data

US 2014/0350800 A1 Nov. 27, 2014

(30) Foreign Application Priority Data

Jan. 25, 2012 (JP) ..... 2012-012948

(51) Int. Cl.

| | |
|---|---|
| ***E02F 9/22*** | (2006.01) |
| ***F02D 29/02*** | (2006.01) |
| ***F02D 1/16*** | (2006.01) |
| ***F02D 31/00*** | (2006.01) |
| ***E02F 3/32*** | (2006.01) |

(52) U.S. Cl.
CPC ..... *E02F 9/2246* (2013.01); *E02F 3/325* (2013.01); *E02F 9/2285* (2013.01); *E02F 9/2296* (2013.01); *F02D 1/16* (2013.01); *F02D 29/02* (2013.01); *F02D 31/008* (2013.01); *F02D 2001/167* (2013.01)

(58) Field of Classification Search
CPC . F02D 29/02; F02D 2001/167; F02D 31/008; F02D 1/16; E02F 9/2246; E02F 3/325; E02F 9/2285; E02F 9/2296
USPC ..... 701/50
See application file for complete search history.

(56) References Cited

FOREIGN PATENT DOCUMENTS

| | | | | |
|---|---|---|---|---|
| JP | 2003-020977 A | * | 1/2003 | ..... F02D 41/04 |
| JP | 2007-056857 A | * | 3/2007 | ..... F02D 9/02 |
| JP | 2008-082303 A | | 4/2008 | |
| JP | 2008-151211 A | | 7/2008 | |

* cited by examiner

*Primary Examiner* — Mary Cheung
*Assistant Examiner* — Brian P Sweeney
(74) *Attorney, Agent, or Firm* — Mattingly & Malur, PC

(57) ABSTRACT

A control device for driving/controlling an engine on the basis of a signal from a temperature state detector, a rotation detector, and a rotational speed setting device is provided. The control device includes a start temperature determining processing unit configured to determine whether or not a temperature (T) at start of the engine is less than a predetermined temperature (Tw1) and a start control processing is performed in accordance with a set value of a target rotational speed (Nset) by the rotational speed setting device in case the start temperature (T) is equal to or less than the predetermined temperature (Tw1). This suppresses occurrence of cavitation by stopping the start of the engine (10) within a range in which the temperature (T) is equal to or lower than the predetermined temperature (Tw1) and the target rotational speed (Nset) of the engine (10) is higher than a predetermined threshold value (Nca).

7 Claims, 11 Drawing Sheets

CONSTRUCTION MACHINE

TECHNICAL FIELD

The present invention relates to a construction machine such as a hydraulic excavator and the like on which an electronically controlled engine is mounted.

BACKGROUND ART

As a construction machine represented by a hydraulic excavator, those on which an electronically controlled diesel engine is mounted as a prime mover are known. In such diesel engine, an exhaust gas purifying device for removing harmful substances in an exhaust gas is provided. On the other hand, by using an electronically controlled fuel injection device, a fuel injection quantity or an injection timing can be controlled with high accuracy. Thus, as compared with a mechanical fuel injection device, startability at a low temperature in a cold area can be improved, and time required for warming-up operation can be reduced (Patent Document 1).

PRIOR ART DOCUMENT

Patent Document

Patent Document 1: Japanese Patent Laid-Open No. 2008-82303A

SUMMARY OF THE INVENTION

The above described conventional art has advantages such as improvement of the startability at a low temperature and time reduction of warming-up operation realized by improved performances of the engine. However, there are also following unsolved problems. That is, the engine of a construction machine has its output shaft directly connected to a hydraulic pump which is a hydraulic source and is configured to rotate/drive the hydraulic pump from start of the engine.

Therefore, even if the engine can be started in an earlier stage under a low-temperature environment such as a cold area, the hydraulic pump continuously sucks and delivers an hydraulic oil having a low temperature and high viscosity from the beginning of its start. As a result, the hydraulic oil sucked into the hydraulic pump from an hydraulic oil tank tends to have a negative pressure, which makes air bubbles and cavitation easily occur and causes reduction in durability and a life of hydraulic equipment.

Particularly, regarding the engine of the construction machine, an operator manually operates a dial of a rotational speed setting device so that a target rotational speed of the engine is variably controlled in a range from a low idling rotational speed to a high idling rotational speed. Thus, in case the engine is started at a low temperature while the dial of the rotational speed setting device is operated to the high idling side, an engine rotational speed rapidly rises to the high idling rotational speed, and it causes a problem that air bubbles and cavitation easily occur in the hydraulic oil.

In view of the above-discussed problems with the conventional art, it is an object of the present invention to provide a construction machine that can suppress occurrence of cavitation caused by the hydraulic oil at start of the engine at a low temperature and can realize stable start control of the engine.

(1) In order to solve the above described problem, the present invention that is applied to a construction machine comprises: an engine to which injection fuel is supplied by an electronically controlled fuel injection device; a temperature state detector for detecting a temperature state of the engine; a rotation detector for detecting a rotational speed of the engine; a rotational speed setting device for setting a target rotational speed of the engine; a control device for driving/controlling the engine on the basis of signals from the temperature state detector, the rotation detector, and the rotational speed setting device; a variable displacement type hydraulic pump which is driven by the engine so as to deliver pressurized oil and is subjected to torque limitation control; and a hydraulic actuator driven by the pressurized oil delivered from the hydraulic pump.

A characteristic of the configuration employed by the present invention is that, the control device includes; a start temperature determining processing unit configured to determine whether or not a temperature at start of the engine has lowered to a predetermined temperature determined in advance on the basis of a detection signal outputted from the temperature state detector; and a start control processing unit configured to perform start control of the engine in accordance with a set value of the target rotational speed by the rotational speed setting device when it is determined by the start temperature determining processing unit that the temperature is equal to or lower than the predetermined temperature.

By configuration as above, if the temperature before start of the engine (a coolant temperature or a temperature of the hydraulic oil, for example) has been lowered to the predetermined temperature determined in advance or less, a suction-side pressure of the hydraulic pump at start of the engine is lowered by the hydraulic oil having high viscosity. As a result, since the suction-side pressure tends to become negative, it can be determined that cavitation can easily occur in the hydraulic oil. Thus, if the temperature is determined by the start temperature determining processing unit to be equal to or lower than the predetermined temperature, the start control processing unit of the control device can perform start control of the engine in accordance with the set value of the engine rotational speed by the rotational speed setting device, and occurrence of cavitation in the hydraulic oil can be suppressed, and breakage of the hydraulic pump can be prevented.

(2) According to the present invention, it is configured such that, in case the set value of the target rotational speed by the rotational speed setting device is equal to or less than a threshold value determined in advance, the start control processing unit starts the engine in accordance with the set value at this time, and in case the set value of the rotational speed setting device is higher than the threshold value, the start control processing unit stops the start of the engine or performs the start control of the engine in accordance with a temporary set value for engine start set in advance.

By configuration as above, if the set value of the target rotational speed by the rotational speed setting device is equal to or less than the threshold value determined in advance, the engine can be started at a relatively low rotational speed, rotation of the hydraulic pump is kept low, and occurrence of cavitation can be suppressed. On the other hand, if the set value of the rotational speed setting device is higher than the threshold value, occurrence of cavitation can be suppressed by stopping start of the engine. Moreover, the start control of the engine can be also performed in accordance with the temporary set value for engine start set in advance, and rotation of the hydraulic pump can be kept low, and occurrence of cavitation can be suppressed.

(3) According to the present invention, it is configured such that in case the set value of the target rotational speed by the rotational speed setting device is equal to or less than a threshold value determined in advance, the start control processing unit starts the engine in accordance with the set value at this time, and in case the set value of the target rotational speed by the rotational speed setting device is higher than the threshold value, the start control processing unit performs the start control of the engine in accordance with a temporary set value for the engine start set in advance to a value lower than a set value of the rotational speed setting device.

By configuration as above, if the set value of the rotational speed setting device is higher than the threshold value, the engine start control can be performed in accordance with the temporary set value for the engine start set in advance (that is, the temporary set value of a value lower than the set value of the rotational speed setting device), and rotation of the hydraulic pump is kept low, and occurrence of cavitation can be suppressed.

(4) According to the present invention, the threshold value is a pump cavitation limit rotational speed as a limit value at which possibility of generation of air bubbles in the hydraulic oil and occurrence of cavitation becomes higher when the hydraulic pump rotates at a low-temperature start of the engine.

(5) According to the present invention, the control device includes: an after-start temperature determining processing unit configured to determine whether or not the temperature of the engine has risen to a determination temperature equal to or higher than the predetermined temperature by a detection signal from the temperature state detector after the start of the engine; and an after-start rotational speed control processing unit configured to control the rotational speed of the engine in accordance with the set value of the target rotational speed by the rotational speed setting device when it is determined by the after-start temperature determining processing unit that the temperature has risen to the determination temperature.

By configuration as above, if the temperature of the engine (a coolant temperature or a temperature of the hydraulic oil, for example) after the start of the engine has risen to the determination temperature, viscosity of the hydraulic oil lowers with the temperature rise, and the after-start temperature determining processing unit can determine that possibility of occurrence of cavitation is low. Thus, in this case, the after-start rotational speed control processing unit can control the engine rotational speed after the start of the engine in accordance with the set value of the target rational speed by the rotational speed setting device. That is, the operator can perform engine control with the rotational speed according to the set value of the target rotational speed by manually operating the rotational speed setting device.

(6) According to the present invention, the after-start rotational speed control processing unit is configured such that, when it is determined by the after-start temperature determining processing unit that the temperature has risen to the determination temperature, the rotational speed of the engine is automatically recovered in accordance with the set value of the target rotational speed by the rotational speed setting device. As a result, after the start of the engine, the engine rotational speed can be automatically recovered to the set value of the target rotational speed by the rotational speed setting device, and after that, the engine control can be performed by the rotational speed according to the manual operation of the operator.

(7) According to the present invention, the start control processing unit of the control device is configured such that, when the temperature is determined by the start temperature determining processing unit to be equal to or lower than the predetermined temperature, the set value of the target rotational speed by the rotational speed setting device is temporarily fixed to a value corresponding to the low idling rotational speed, and the engine is subjected to start control in accordance with this fixed set value, and the control device comprises: an after-start temperature determining processing unit configured to determine whether or not the temperature of the engine has risen to a determination temperature equal to or higher than the predetermined temperature by the detection signal from the temperature state detector after the start of the engine; and an after-start rotational speed control processing unit configured to cancel control of the engine rotational speed by the fixed set value when it is determined by the after-start temperature determining processing unit that the temperature has risen to the determination temperature.

By configuration as above, when it is determined that a suction pressure of the hydraulic pump lowers at start of the engine, and cavitation can easily occur in the hydraulic oil, the engine can be subjected to start control in accordance with the fixed set value corresponding to the low idling rotational speed, and the rotational speed at the engine start can be kept low. Moreover, when viscosity of the hydraulic oil lowers with the temperature rise after the engine start, and possibility of occurrence of cavitation is low, the control of the engine rotational speed by the fixed set value can be cancelled.

(8) According to the present invention, the after-start rotational speed control processing unit is configured such that, when the after-start temperature determining processing unit determines that the temperature has risen to the determination temperature, the control of the target rotational speed by the fixed set value is continued until an operator changes the set value of the rotational speed setting device to a value corresponding to the low idling rotational speed, and the control of the target rotational speed by the fixed set value is cancelled in response to the changing operation by the operator.

By configuration as above, the control of the engine rotational speed by the fixed set value can be continued until the operator changes the set value of the rotational speed setting device to a value corresponding to the low idling rotational speed after the start of the engine, and the control of the engine rotational speed by the fixed set value can be cancelled when the operator performs a changing operation. As a result, after that, the engine rotational speed can be variably controlled with the rotational speed (that is, in a range from the low idling rotational speed to the high idling rotational speed) according to the manual operation by the operator.

(9) According to the present invention, the after-start rotational speed control processing unit is configured to control the rotational speed of the engine in accordance with a set value of the target rotational speed by the rotational speed setting device at the time of cancelling the control of the target rotational speed by the fixed set value. As a result, after the control of the target rotational speed by the fixed set value is cancelled, the engine rotational speed can be controlled in accordance with the set value of the target rotational speed by the rotational speed setting device, and the operator can perform engine control with the rotational speed according to the set value of the target rotational speed by manually operating the rotational speed setting device.

BRIEF DESCRIPTION OF THE DRAWINGS

FIG. 3 is an entire configuration diagram showing an engine, a hydraulic pump, a control valve, a hydraulic actuator, an exhaust gas purifying device, a control device and the like.

MODE FOR CARRYING OUT THE INVENTION

Figure 1:
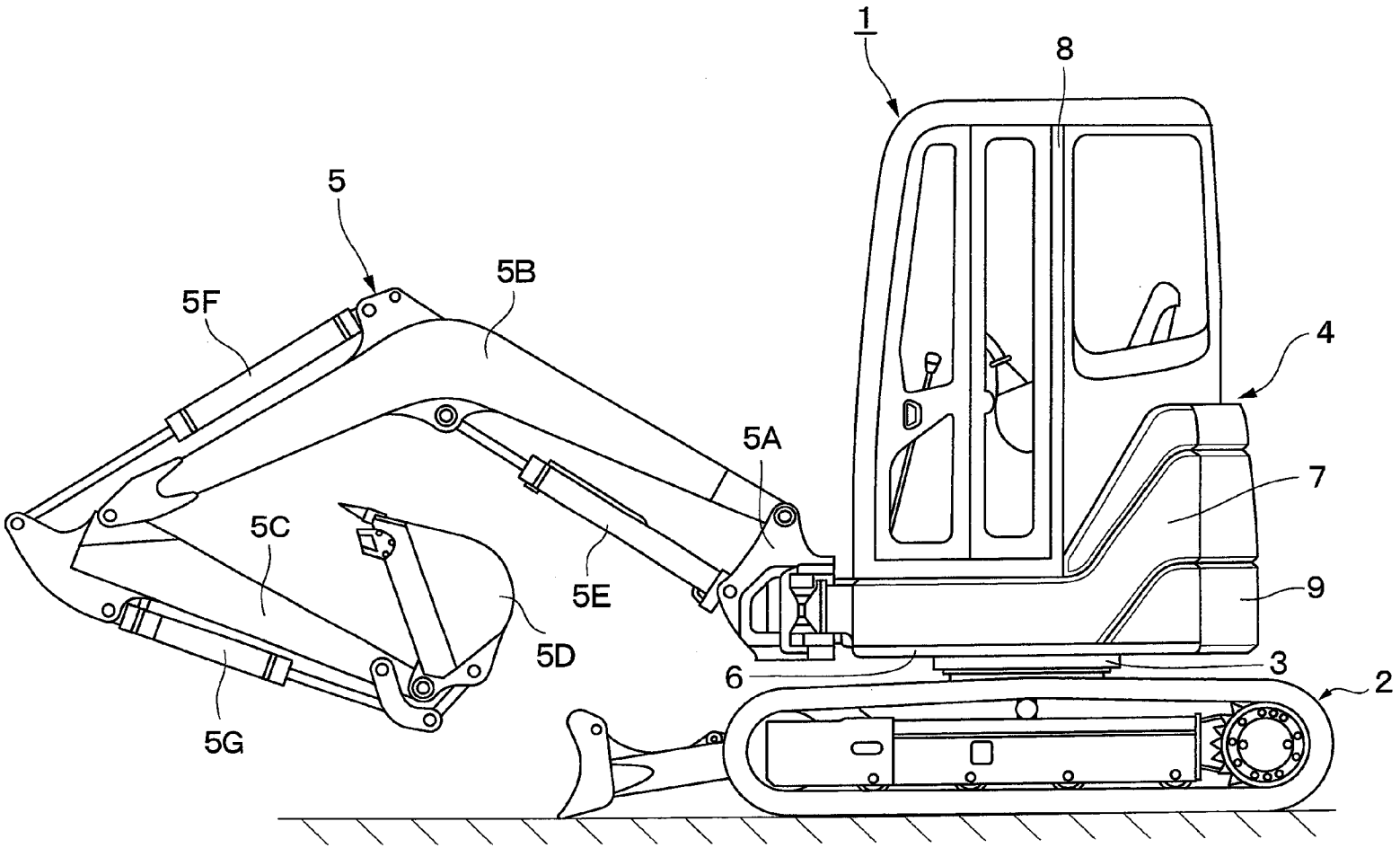
FIG. 1 is a front view showing a hydraulic excavator according to a first embodiment of the present invention.

Hereinafter, an embodiment of a construction machine according to the present invention will be in detail explained in accordance with the attached drawings by taking a case of a small-sized hydraulic excavator as an example.

FIGS. 1 to 7 show a hydraulic excavator according to a first embodiment of the present invention.

In the figures, designated at 1 is a small-sized hydraulic excavator used for an excavating work of earth and sand and the like, an earth removing work and the like. This hydraulic excavator 1 includes an automotive crawler-type lower traveling structure 2, an upper revolving structure 4 rotatably mounted on the lower traveling structure 2 through a revolving device 3 and constituting a vehicle body together with the lower traveling structure 2, and a working mechanism 5 provided capable of moving upward/downward on a front side of the upper revolving structure 4.

Here, the working mechanism 5 is constituted as a swing-post type working mechanism. This working mechanism 5 includes a swing post 5A, a boom 5B, an arm 5C, a bucket 5D as a working tool, a swing cylinder (not shown), a boom cylinder 5E, an arm cylinder 5F, and a bucket cylinder 5G. The upper revolving structure 4 is constructed with including a revolving frame 6, an exterior cover 7, a cab 8, and a counterweight 9 which will be described later.

The revolving frame 6 is a support structural body of the upper revolving structure 4, and the revolving frame 6 is mounted on the lower traveling structure 2 through the revolving device 3. On the revolving frame 6, the counterweight 9 and an engine 10 which will be described later are provided on a rear side thereof, and the cab 8 which will be described later is provided on a left front side. Moreover, on the revolving frame 6, the exterior cover 7 is provided at a position between the cab 8 and the counterweight 9, and in this exterior cover 7, a fuel tank (not shown) is accommodated in addition to the engine 10, a hydraulic pump 13, and a heat exchanger 15.

Figure 3:
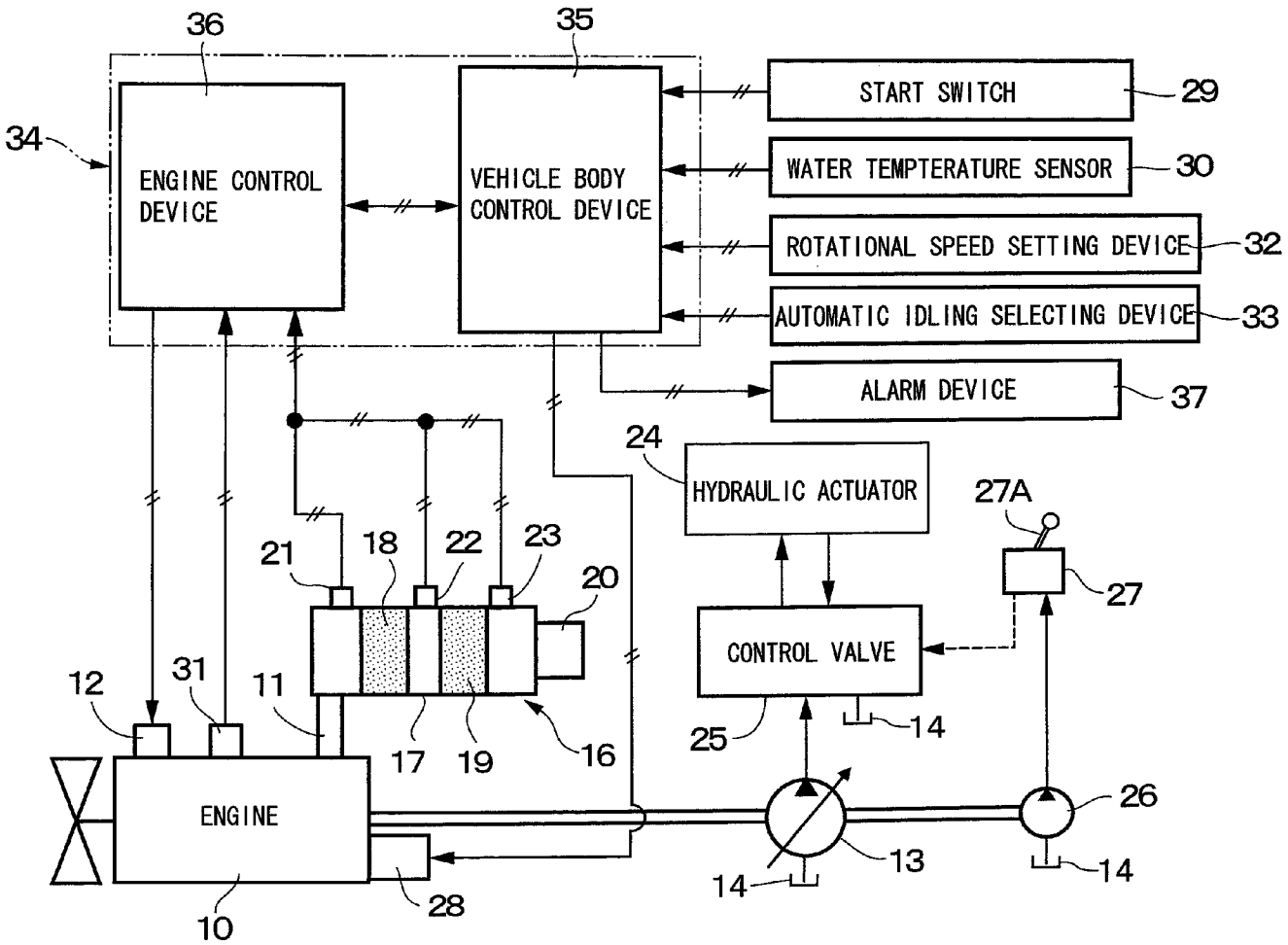

The cab 8 is mounted on the left front side of the revolving frame 6, and the cab 8 defines an operator's cabin on which an operator gets therein. Inside the cab 8, an operator's seat on which the operator is seated, various operating levers (only an operating lever 27A which will be described later is shown in FIG. 3), a start switch 29, a rotational speed setting device 32, an automatic idling selecting device 33 and the like which will be described later are disposed.

Figure 2:
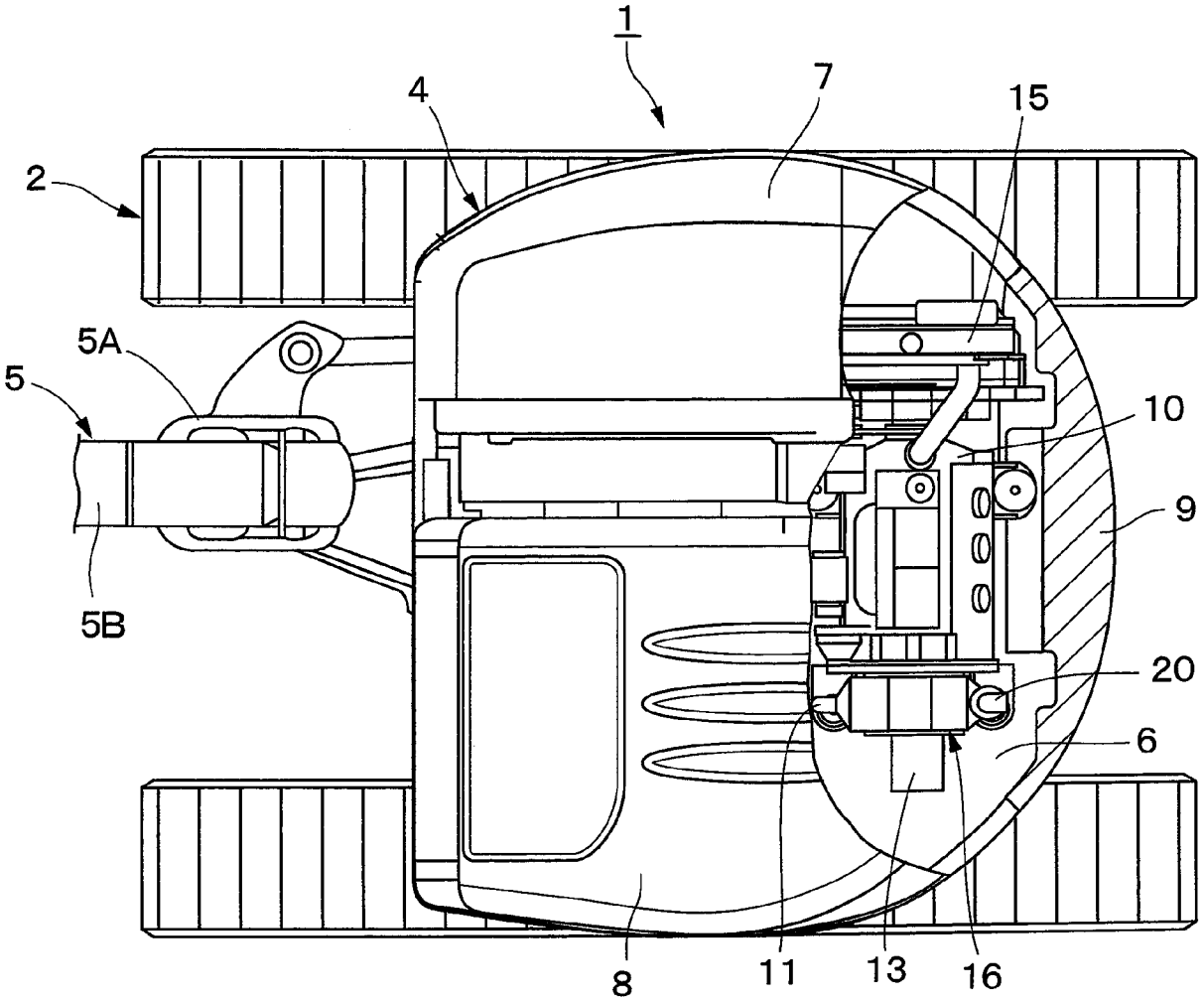
FIG. 2 is a partially broken plan view showing the hydraulic excavator in an enlarged manner in a state in which a part of a cab and an exterior cover in an upper revolving structure in FIG. 1 is removed.

The counterweight 9 is to take a weight balance with the working mechanism 5, and the counterweight 9 is located on the rear side of the engine 10 which will be described later and is mounted on a rear end portion of the revolving frame 6. As shown in FIG. 2, a rear surface side of the counterweight 9 is formed having an arc shape and is configured such that a revolving radius of the upper revolving structure 4 is contained small.

Next, the engine 10, the hydraulic pump 13 attached to the engine 10, an exhaust gas purifying device 16 and the like will be described.

Indicated at 10 is the engine arranged in a laterally placed state on the rear side of the revolving frame 6, and since the engine 10 is mounted as a prime mover on the small-sized hydraulic excavator 1 as described above, it is constituted by using a small-sized diesel engine, for example. As shown in FIG. 2, an exhaust pipe 11 forming a part of an exhaust gas passage is provided on a left side of the engine 10, and the exhaust gas purifying device 16 which will be described later is provided by being connected to the exhaust pipe 11.

Here, the engine 10 is provided with an electronic governor 12 (see, FIG. 3) having an electronically controlled fuel injection device, and a supply amount of an injection fuel is variably controlled by this electronic governor 12. That is, the electronic governor 12 variably controls an injection quantity of a fuel to be supplied to the engine 10 on the basis of a control signal outputted from an engine control device 36 which will be described later. As a result, the rotational speed of the engine 10 is controlled so as to be a rotational speed corresponding to a target rotational speed by the control signal.

Indicated at 13 is a hydraulic pump provided on the left side of the engine 10, and the hydraulic pump 13 constitutes a main hydraulic source together with an hydraulic oil tank 14 (see, FIG. 3). As the hydraulic pump 13, a variable displacement type hydraulic pump subjected to torque limitation control is used so that a limited output horsepower of the engine 10 can be effectively used. Here, the variable displacement type hydraulic pump subjected to torque limitation control is controlled so that a relationship between a delivery pressure P and a delivery amount Q of the pressurized oil satisfies the known "P-Q characteristic". The hydraulic pump 13 is constituted by a variable displacement type swash-plate, bent axis type or radial piston type hydraulic pump type, for example.

As shown in FIG. 2, the hydraulic pump 13 is mounted on the left side of the engine 10 through a power transmission device (not shown), and a rotation output of the engine 10 is transmitted by this power transmission device. The hydraulic pump 13, if being driven by the engine 10, sucks an oil liquid in the hydraulic oil tank 14 and delivers a pressurized oil toward a control valve 25 and the like which will be described later.

The heat exchanger 15 is provided on the revolving frame 6 at a position opposite to the hydraulic pump 13, sandwiching the engine 10 therebetween. This heat exchanger 15 includes a radiator, an oil cooler and an intercooler, for example. That is, the heat exchanger 15 cools the engine 10 and also cools the pressurized oil (hydraulic oil) returned to the hydraulic oil tank 14.

Designated at 16 is an exhaust gas purifying device for removing and purifying harmful substances contained in the exhaust gas of the engine 10. As shown in FIG. 2, this exhaust gas purifying device 16 is disposed on an upper left side of the engine 10 and at a position on an upper side of the hydraulic pump 13. In the exhaust gas purifying device 16, the exhaust pipe 11 of the engine 10 is connected to its upstream side. The exhaust gas purifying device 16 constitutes the exhaust gas passage together with the exhaust pipe 11 and removes harmful substances contained in this exhaust gas while the exhaust gas flows from the upstream side to a downstream side.

That is, the engine 10 constituted by the diesel engine is highly efficient and excellent in durability. However, in the exhaust gas of the engine 10, harmful substances such as particulate matter (PM), nitrogen oxides (NOx), carbon monoxide (CO) and the like are contained. Thus, the exhaust gas purifying device 16 mounted on the exhaust pipe 11 includes an oxidation catalyst 18 which will be described later for oxidizing and removing carbon monoxide (CO) and hydrocarbon (HC) and a particulate matter removing filter 19 which will be described later for trapping and removing the particulate matter (PM).

As shown in FIG. 3, the exhaust gas purifying device 16 has a cylindrical casing 17 constituted by detachably connecting a plurality of cylindrical bodies to front and rear. In the casing 17, the oxidation catalyst 18 (normally referred to as a Diesel Oxidation Catalyst or abbreviated as DOC) and the particulate matter removing filter 19 (normally referred to as a Diesel Particulate Filter or abbreviated as DPF) are removably contained.

The oxidation catalyst 18 is made of a cell-like cylindrical body made of ceramic having an outer diameter dimension equal to an inner diameter dimension of the casing 17, for example, and a large number of through holes (not shown) are formed in its axial direction and its inner surface is coated with precious metal. The oxidation catalyst 18 has the exhaust gas flow through each of the through holes under a predetermined temperature condition and oxidizes and removes carbon monoxide (CO), hydrocarbon (HC) and the like contained in this exhaust gas and removes nitrogen oxides (NOx) as nitrogen dioxide (NO2).

The particulate matter removing filter 19 is arranged on a downstream side of the oxidation catalyst 18 in the casing 17. The particulate matter removing filter 19 traps the particulate matter in the exhaust gas exhausted from the engine 10 and burns and removes the trapped particulate matter so as to purify the exhaust gas. For this purpose, the particulate matter removing filter 19 is constituted by a cell-like cylindrical body in which a large number of small holes (not shown) are provided in an axial direction in a porous material made of a ceramic material, for example. Therefore, the particulate matter removing filter 19 traps the particulate matter through the large number of small holes, and the trapped particulate matter is burned and removed as described above. As a result, the particulate matter removing filter 19 is regenerated.

As shown in FIG. 3, a outlet port 20 of the exhaust gas is provided on a downstream side of the exhaust gas purifying device 16. This outlet port 20 is located on the downstream side of the particulate matter removing filter 19 and connected to an outlet side of the casing 17. This outlet port 20 is constituted by including a funnel which emits the exhaust gas after purification processing to the atmospheric air, for example.

An exhaust gas temperature sensor 21 detects a temperature of the exhaust gas. This exhaust gas temperature sensor 21 is mounted on the casing 17 of the exhaust gas purifying device 16 and detects a temperature of the exhaust gas exhausted from the exhaust pipe 11 side, for example. The temperature detected by the exhaust gas temperature sensor 21 is outputted to the engine control device 36 which will be described later as a detection signal.

Gas pressure sensors 22 and 23 are provided on the casing 17 of the exhaust gas purifying device 16. These gas pressure sensors 22 and 23 are arranged separately from each other while sandwiching the particulate matter removing filter 19. The one gas pressure sensor 22 detects a gas pressure of the exhaust gas on the upstream side (inlet side) of the particulate matter removing filter 19 as a pressure P1, while the other gas pressure sensor 23 detects a gas pressure of the exhaust gas on the downstream side (outlet side) of the particulate matter removing filter 19 as a pressure P2. The gas pressure sensors 22 and 23 output the respective detection signals to the engine control device 36 which will be described later.

The engine control device 36 calculates a pressure difference ΔP between the pressure P1 on the upstream side detected by the gas pressure sensor 22 and the pressure P2 on the downstream side detected by the gas pressure sensor 23 in accordance with a formula 1 below. The engine control device 36 is to estimate deposited amount, that is, the trapped amount of the particulate matter adhering to the particulate matter removing filter 19, an unburned residues and the like from a calculation result of the pressure difference ΔP. In this case, the pressure difference ΔP becomes a small pressure value if the trapped amount is small and becomes a high pressure value as the trapped amount increases.

$$\Delta P = P1 - P2 \quad \text{[Formula 1]}$$

A plurality of hydraulic actuators 24 (only one of them is shown in FIG. 3) is driven by the pressurized oil delivered from the hydraulic pump 13. These hydraulic actuators 24 include the swing cylinder (not shown), the boom cylinder 5E, the arm cylinder 5F or the bucket cylinder 5G (see, FIG. 1) of the working mechanism 5, for example. As the hydraulic actuator 24 mounted on the hydraulic excavator 1 includes a hydraulic motor for traveling, a hydraulic motor for revolving, and an elevation cylinder for a blade (none of them is shown), for example.

A plurality of control valves 25 (only one of them is shown in FIG. 3) constitutes a directional control valve for the hydraulic actuator 24. These control valves 25 are provided between a hydraulic source constituted by the hydraulic pump 13 and the hydraulic oil tank 14 and each of the hydraulic actuators 24, respectively. Each of the control valves 25 variably controls a flow rate and a direction of the pressurized oil to be supplied to each of the hydraulic actuators 24 by supply of a pilot pressure from an operating valve 27 which will be described later.

A pilot pump 26 is an auxiliary hydraulic pump constituting an auxiliary hydraulic source together with the hydraulic oil tank 14. As shown in FIG. 3, this pilot pump 26 is rotated/driven by the engine 10 together with the main hydraulic pump 13. The pilot pump 26 delivers the hydraulic oil sucked in from the inside of the hydraulic oil tank 14 toward the operating valve 27 and the like which will be described later.

The operating valve 27 is constituted by a reducing-valve type pilot operating valve. This operating valve 27 is provided in the cab 8 of the hydraulic excavator 1 (see, FIG. 1) and has the operating lever 27A tilted/operated by the operator. The operating valve 27 is arranged in the number corresponding to the plurality of control valves 25 for remotely controlling the plurality of hydraulic actuators 24 individually. That is, when the operator tiltably operates the operating lever 27A, each of the operating valves 27 supplies a pilot pressure corresponding to its operation amount to a hydraulic pilot portion (not shown) of each of the control valves 25.

As a result, the control valve 25 is switched to left or right switching positions from a neutral position. If the control valve 25 is switched to one of the switching positions, the hydraulic actuator 24 is driven in the applicable direction by the pressurized oil from the hydraulic pump 13 supplied in one direction. On the other hand, if the control valve 25 is switched to the other switching position, the hydraulic actuator 24 is driven in an opposite direction by the pressurized oil from the hydraulic pump 13 supplied in the other direction.

A starter 28 is to start the engine 10. This starter 28 is constituted by an electric motor for rotating/driving a crank shaft of the engine 10 (none of them is shown). The starter 28 starts the engine 10 if the operator manually operates (that is, turns on the key) a start switch 29 provided in the cab 8 of the hydraulic excavator 1. As a result, the engine 10 is started.

Next, a water temperature sensor 30, a rotation detector 31, the rotational speed setting device 32, the control device 34 and the like used for control at start and after start of the engine 10 will be described.

Indicated at 30 is a water temperature sensor as a temperature state detector for detecting a temperature state of the engine 10. This water temperature sensor 30 detects a coolant temperature of the engine 10 as an engine temperature (T) and outputs its detection signal to a vehicle body control device 35 which will be described later. As the temperature state detector for detecting the temperature state of the engine 10, other than the water temperature sensor 30, a temperature sensor for detecting an intake air temperature of the engine 10, a temperature sensor of an engine oil, a temperature sensor for detecting an oil temperature of the hydraulic oil or a temperature sensor for detecting an ambient temperature (outside air temperature) at a position in the vicinity of the engine 10 can be used. In this embodiment, a case in which the water temperature sensor 30 is used as a temperature state detector will be described as an example.

Indicated at 31 is a rotation detector for detecting a rotational speed of the engine 10, and the rotation detector 31 detects an engine rotational speed N and outputs its detection signal to the engine control device 36 which will be described later. The engine control device 36 monitors an actual rotational speed of the engine 10 on the basis of the detection signal of the engine rotational speed N and controls the engine rotational speed N in accordance with a target rotational speed Nset set by the rotational speed setting device 32 which will be described later.

Indicated at 32 is the rotational speed setting device for setting the target rotational speed Nset of the engine 10, and the rotational speed setting device 32 is provided in the cab 8 of the hydraulic excavator 1 (see, FIG. 1) and is constituted by an operation dial (see, FIG. 4) manually operated by the operator. The rotational speed setting device 32 is not limited to the operation dial shown in FIG. 4 but may be constituted also by a known up-down switch or an engine lever (none of them is shown), for example.

Figure 4:
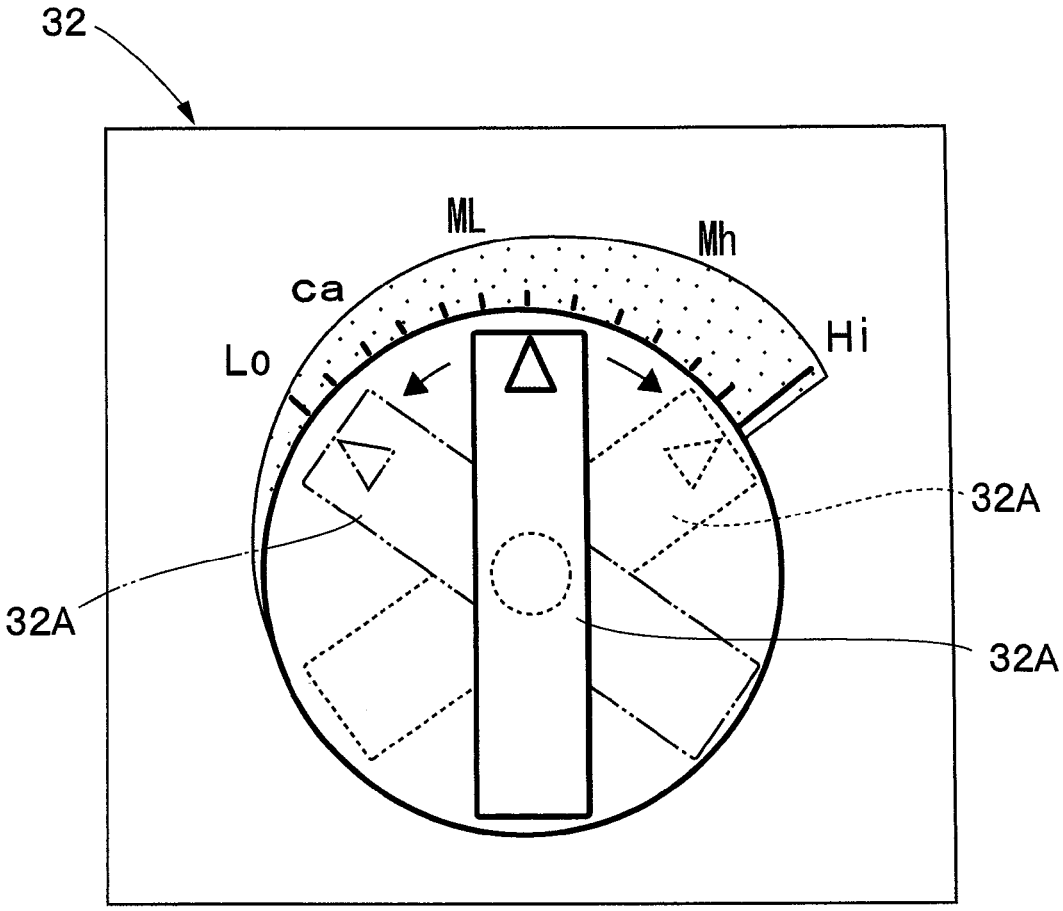
FIG. 4 is a front view showing an operation dial used as a rotational speed setting device in FIG. 3.

As shown in FIG. 4, the rotational speed setting device 32 has a dial 32A manually rotated/operated by the operator. The rotational speed setting device 32 is configured such that, when the operator manually rotates/operates the dial 32A within a range of the set values from "Lo" to "Hi", an instruction signal of the target rotational speed Nset according to the set value at this time is outputted to the vehicle body control device 35 which will be described later. In the rotational speed setting device 32, if the operator rotates the dial 32A to a position indicated by a two-dot chain line in FIG. 4, the set value of the engine rotational speed becomes "Lo", and if the dial 32A is rotated to a position indicated by a dot line in FIG. 4, the set value of the engine rotational speed becomes "Hi".

Figure 5:
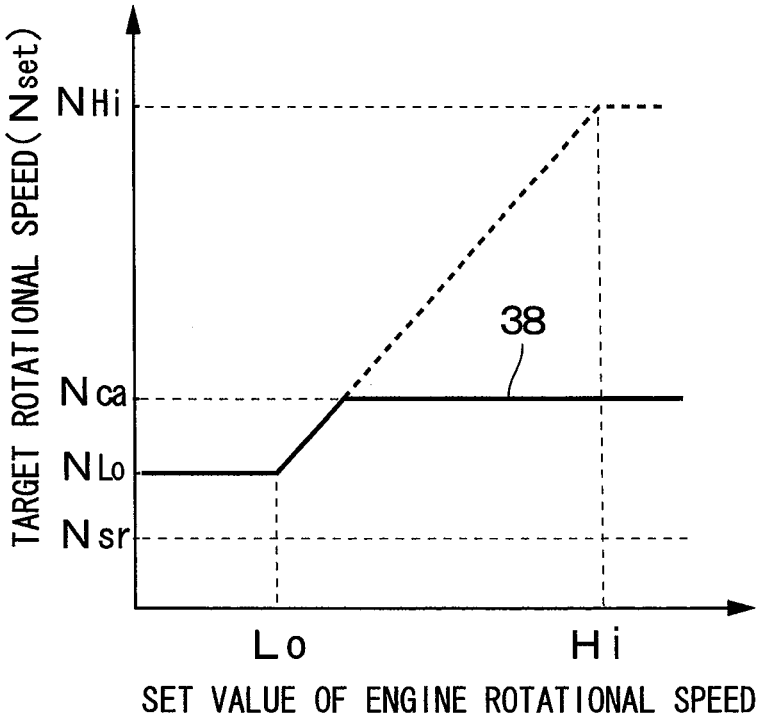
FIG. 5 is a characteristic line diagram showing a relationship between a set value of an engine rotational speed by the rotational speed setting device and a target rotational speed.

As shown in FIG. 5, if the operator rotates the dial 32A of the rotational speed setting device 32 to the position of the set value "Lo", the target rotational speed Nset of the engine 10 is set to a low idling rotational speed NLo (1200 rpm, as an example). If the dial 32A of the rotational speed setting device 32 is rotated to the position of the set value "Hi", the target rotational speed Nset of the engine 10 is set to a high idling rotational speed NHi (2400 rpm, as an example).

As described above, if the operator variably rotates/operates the dial 32A of the rotational speed setting device 32 within the range of the set values "Lo" to "Hi", the target rotational speed Nset of the engine 10 is variably controlled within a range from the low idling rotational speed NLo to the high idling rotational speed NHi. Moreover, in the first embodiment, if the dial 32A of the rotational speed setting device 32 is rotated/operated to a position of a set value "ca" indicated in FIG. 4, the target rotational speed Nset is set to a pump cavitation limit rotational speed Nca (however, NHi>Nca>NLo) as a characteristic line 38 indicated by a solid line in FIG. 5. It should be noted that the pump cavitation limit rotational speed Nca may be a rotational speed equal to or less than the low idling rotational speed NLo (Nca≤NLo) under a severe climate condition such as a cold area.

An automatic idling selecting device 33 is used for performing automatic idling control of the engine 10. This automatic idling selecting device 33 is constituted by a selecting switch provided in the cab 8 of the hydraulic excavator 1 and is turned ON/OFF by the operator. The automatic idling selecting device 33 outputs an ON signal or an OFF signal at this time to the vehicle body control device 35 which will be described later. That is, if the automatic idling selecting device 33 is operated to be ON, automatic idling control is performed so as to lower the engine rotational speed N to an automatic idling rotational speed determined in advance (to the low idling rotational speed NLo, for example) as will be described later. However, if the automatic idling selecting device 33 is operated to be OFF, the automatic idling control is not performed, and the engine rotational speed N is controlled in accordance with the target rotational speed Nset set by the rotational speed setting device 32.

Designated at 34 is the control device of the hydraulic excavator 1, and as shown in FIG. 3, the control device 34 includes the vehicle body control device 35 and the engine control device 36. The vehicle body control device 35 constituting the control device 34 has its input side connected to the start switch 29, the water temperature sensor 30, the rotational speed setting device 32, and the automatic idling selecting device 33 and its output side connected to the starter 28 and an alarm device 37. This alarm device 37 is constituted by using any one or more of a display device such as a display, an alarm lamp, a sound synthesizing device, and an alarm buzzer, which are provided in the cab 8, respectively.

Here, the vehicle body control device 35 performs start control of the engine 10 by starting the starter 28 when the start switch 29 is operated to be key ON. On the other hand, the vehicle body control device 35 also has a function of outputting an instruction signal for setting the target rotational speed of the engine 10 to the engine control device 36 in accordance with a signal outputted from the rotational speed setting device 32 and the automatic idling selecting device 33.

On the other hand, the engine control device 36 constituting the control device 34 performs predetermined calculation processing on the basis of the instruction signal outputted from the vehicle body control device 35 and a detection signal of the engine rotational speed N outputted from the rotation detector 31 and outputs a control signal for instructing a target fuel injection quantity to the electronic governor 12 of the engine 10. The electronic governor 12 of the engine 10 increases/decreases the fuel injection quantity to be injected/supplied into a combustion chamber (not shown) of the engine 10 in accordance with the control signal or stops injection of the fuel. As a result, the rotational speed of the engine 10 is controlled so as to become a rotational speed corresponding to the target rotational speed instructed by the instruction signal from the vehicle body control device 35.

That is, the engine control device 36 controls the rotational speed of the engine 10 in accordance with the set value (target rotational speed) by the rotational speed setting device 32 if the automatic idling selecting device 33 is operated to be OFF. However, if the automatic idling selecting device 33 is operated to be ON, and an operation detector (not shown) on the operating valve 27 side detects that all the control valves 25 are at the neutral position, the engine control device 36 has a function of controlling the rotational speed of the engine 10 at the automatic idling rotational speed regardless of the set value.

The engine control device 36 has its input side connected to the exhaust gas temperature sensor 21, the gas pressure sensors 22 and 23, the rotation detector 31, and the vehicle body control device 35, and its output side is connected to the electronic governor 12 of the engine 10 and the vehicle body control device 35. Moreover, the engine control device 36 has a memory portion (not shown) composed of a ROM, a RAM, a nonvolatile memory and the like. In this memory portion, a processing program for performing start control of the engine 10 shown in FIG. 7 which will be described later and the like, the pump cavitation limit rotational speed Nca as a threshold value determined in advance, an engine start recognition rotational speed Nsr, and a predetermined temperature Tw1 determined in advance as a temperature T of the coolant (Tw1=−5° C., for example) are stored.

Here, the pump cavitation limit rotational speed Nca, the engine start recognition rotational speed Nsr, and the predetermined temperature Tw1 are numeral values determined in advance in accordance with experiment data and the like. That is, the engine start recognition rotational speed Nsr is for determining whether or not the engine 10 can be started by the starter 28 on whether or not the engine rotational speed N is equal to or more than the rotational speed Nsr at start of the engine 10. As shown in FIG. 5, the engine start recognition rotational speed Nsr is a rotational speed lower than the low idling rotational speed NLo.

Subsequently, a case in which the temperature T of the coolant has lowered to the predetermined temperature Tw1 (−5° C., for example) or less will be examined. If the engine rotational speed N is equal to or less than the pump cavitation limit rotational speed Nca, the rotation number of the hydraulic pump 13 is also low, and it can be determined that the possibility of generation of air bubbles in the hydraulic oil sucked and delivered by the hydraulic pump 13 and occurrence of cavitation is low. However, if the engine rotational speed N (that is, the rotation number of the hydraulic pump 13) becomes higher than the pump cavitation limit rotational speed Nca in a state in which the temperature T of the coolant is low, it can be determined that the possibility of generation of air bubbles in the hydraulic oil by the hydraulic pump 13 and occurrence of cavitation is high. In the first embodiment, the pump cavitation limit rotational speed Nca is a rotational speed higher than the low idling rotational speed NLo and lower than the high idling rotational speed NHi.

Thus, in the start control processing of the engine 10 shown in FIG. 7, it is determined by the start temperature determining processing unit at Step 2 which will be described later whether or not the temperature T of the coolant at start of the engine 10 has been lowered to the predetermined temperature Tw1. Moreover, in the start control processing unit by Steps 3 to 6 and Steps 8 to 10 which will be described later, start control of the engine 10 is performed in accordance with the set value of the engine rotational speed.

Figure 6:
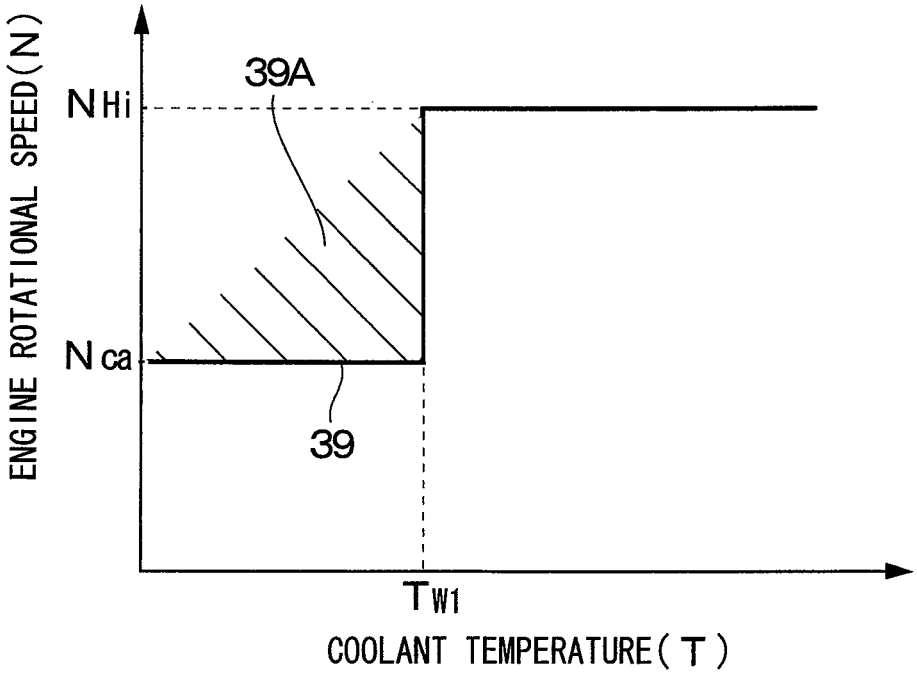
FIG. 6 is a characteristic line diagram showing a relationship between a coolant temperature and the engine rotational speed at start of the engine.

A characteristic line 39 in FIG. 6 divides a cavitation generation region in relation between the temperature T of the coolant and the engine rotational speed N. A range 39A indicated by hatching on an upper side of the characteristic line 39 indicates a region where cavitation can easily occur in the hydraulic oil by rotation/driving the hydraulic pump 13 at start of the engine 10. That is, the range 39A by the characteristic line 39 is a range in which the temperature T of the coolant has lowered to the predetermined temperature Tw1 or less and the target rotational speed Nset of the engine 10 is higher than the pump cavitation limit rotational speed Nca.

The hydraulic excavator 1 according to the first embodiment has the configuration as described above, and its operation will be described below.

First, the operator of the hydraulic excavator 1 gets on the cab 8 of the upper revolving structure 4, starts the engine 10, and drives the hydraulic pump 13 and the pilot pump 26. Therefore, the pressurized oil is delivered from the hydraulic pump 13, and this pressurized oil is supplied to the hydraulic actuator 24 through the control valve 25. From the control valves (not shown) other than this, the pressurized oil are supplied to the other hydraulic actuators (hydraulic motors for traveling and revolving or other hydraulic cylinders and the like, for example). When the operator onboard the cab 8 operates the operating lever (not shown) for traveling, the vehicle can be advanced or retreated by the lower traveling structure 2.

On the other hand, the operator in the cab 8 can perform an excavating work of earth and sand and the like by moving the working mechanism 5 upward/downward by operating the operating lever (that is, the operating lever 27A of the operating valve 27 shown in FIG. 3) for work. Since the small-sized hydraulic excavator 1 has a small revolving radius by the upper revolving structure 4, even in a small work site such as a city area, the gutter excavating work can be performed by the working mechanism 5 while revolving/driving the upper revolving structure 4, and in such a case, a noise is reduced by operating the engine 10 in a light load state in some cases.

During the operation of the engine 10, particulate matter which is a harmful substance is exhausted from its exhaust pipe 11. At this time, the exhaust gas purifying device 16 can oxidize and remove hydrocarbon (HC), nitrogen oxides (NOx), and carbon monoxide (CO) in the exhaust gas by the oxidation catalyst 18. The particulate matter removing filter 19 traps the particulate matter contained in the exhaust gas and burns and removes (regenerates) the trapped particulate matter. As a result, the purified exhaust gas can be exhausted from the outlet port 20 on the downstream side to the outside.

Incidentally, since the engine 10 has improved performances by being provided with the electronic governor 12 having an electronically controlled fuel injection device (see, FIG. 3), its low-temperature startability is improved and has an advantage that time for warming-up operation can be reduced. However, the engine 10 used as a prime mover for the hydraulic excavator 1 has its output shaft directly connected to the hydraulic pump 13 which is a hydraulic source and is configured such that the hydraulic pump 13 is rotated/driven from start up of the engine. Thus, in a cold area where the ambient temperature can be below 0° C., even if the engine 10 can be started in an earlier stage, the hydraulic pump 13 continuously sucks and delivers the hydraulic oil having a low temperature and high viscosity from the initial stage of the start.

Particularly, the engine 10 of the hydraulic excavator 1 is variably controlled so that the target rotational speed Nset of the engine 10 falls within a range from the low idling rotational speed NLo to the high idling rotational speed NHi by manual rotation/operation of the dial 32A (see, FIG. 4) of the rotational speed setting device 32 by the operator. Thus, when low-temperature start of the engine 10 is performed while the dial 32A of the rotational speed setting device 32 is rotated/operated to the high idling side (that is, on the set value "Hi" side in FIG. 4), the engine rotational speed N rapidly rises to the high idling rotational speed NHi, and air bubbles and cavitation can easily occur in the hydraulic oil.

Figure 7:
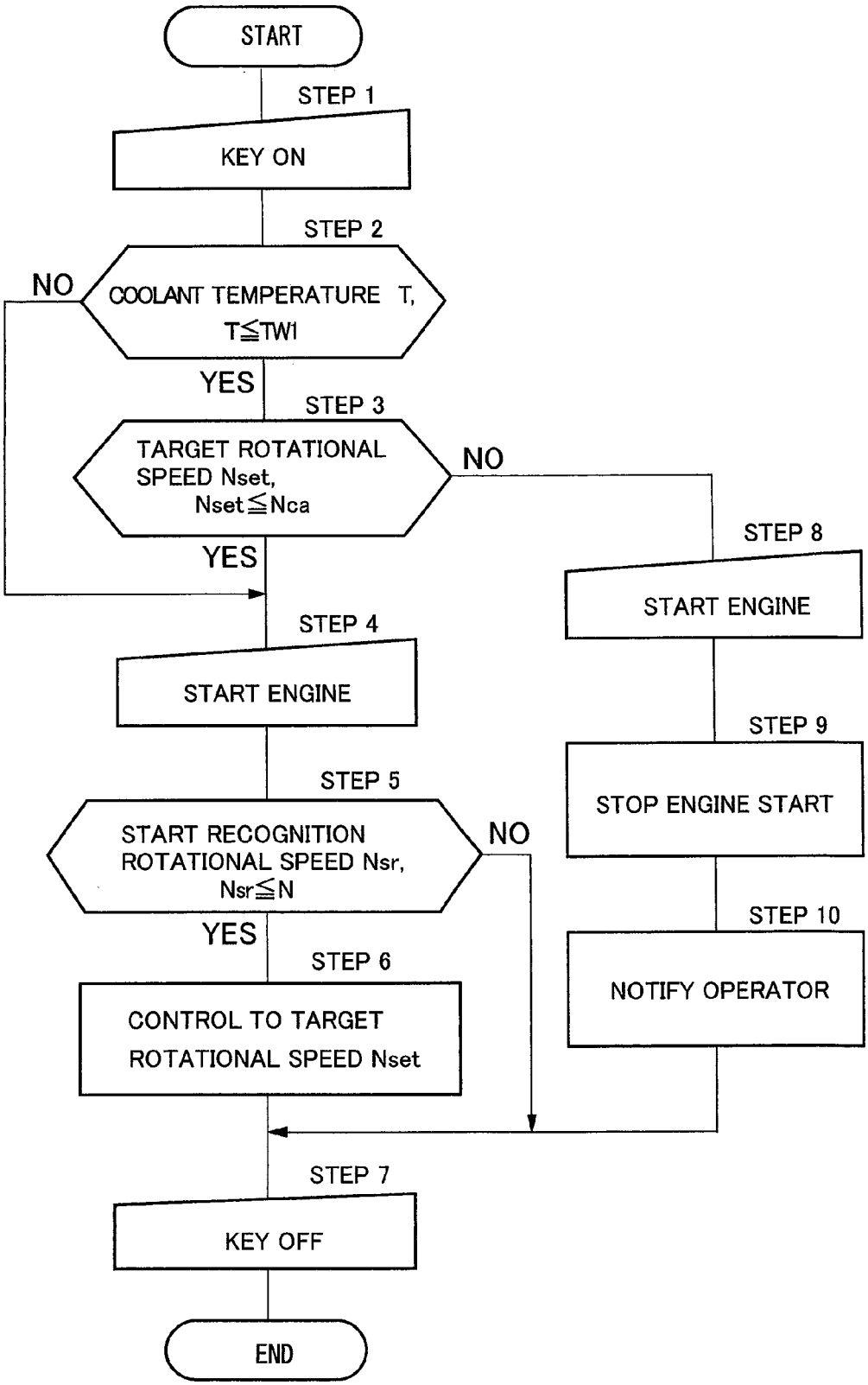
FIG. 7 is a flowchart showing control processing at start of the engine by the control device.

Thus, in the first embodiment, by performing the start control of the engine 10 in accordance with the processing program shown in FIG. 7, occurrence of cavitation by the hydraulic oil can be suppressed even at the low-temperature start of the engine 10, and stable start control of the engine 10 can be realized. It should be noted that the above described problem is a problem unique to the engine 10 provided with the electronic governor 12 having an electronically controlled fuel injection device and having improved performances. On the other hand, in case a mechanical fuel injection device is used, since a rising performance of the engine is low, it does not make a big problem.

A processing operation shown in FIG. 7 is started. The start switch 29 is "key ON" at Step 1, and at the subsequent Step 2, it is determined whether or not the temperature T of the coolant at start of the engine 10 is equal to or lower than the predetermined temperature Tw1 (−5° C., for example). When it is determined to be "NO" at Step 2, since the temperature T of the coolant is higher than the predetermined temperature Tw1, it can be determined that, even if the hydraulic oil is sucked by the hydraulic pump 13 with start of the engine 10, there is no concern of occurrence of cavitation.

Thus, in this case, the routine moves to Step 4, where the starter 28 is operated, and the engine 10 is started. At the subsequent Step 5, it is determined whether the start rotational speed N of the engine 10 has reached the engine start recognition rotational speed Nsr, that is, whether or not the detected rotational speed by the rotation detector 31 is equal to or more than the rotational speed Nsr. When it is determined to be "NO" at Step 5, it means a case in which the engine rotational speed N is lower than the engine start recognition rotational speed Nsr, and the engine 10 cannot be started, and thus, the routine moves to Step 7 which will be described later and waits for the operator to perform "key OFF" of the start switch 29.

When it is determined to be "YES" at Step 5, it means a case in which the engine 10 could be started by the starter 28 and engine start was successful, and the routine proceeds to the subsequent Step 6, and rotational speed control of the engine 10 (that is, fuel injection quantity control by the electronic governor 12) is performed so that the rotational speed N of the engine 10 becomes a rotational speed corresponding to the target rotational speed Nset selected by the rotational speed setting device 32. Such engine control processing at Step 6 is continued until the operator performs "key OFF" of the start switch 29 at Step 7.

On the other hand, when it is determined to be "YES" at the above described Step 2, the temperature T of the coolant has lowered to the predetermined temperature Tw1 or less. Thus, at the subsequent Step 3, it is determined whether or not the target rotational speed Nset selectively set by the rotational speed setting device 32 has been lowered to the pump cavitation limit rotational speed Nca or less. When it is determined to be "YES" at Step 3, the engine rotational speed N has lowered to the pump cavitation limit rotational speed Nca or less, and it can be determined that the possibility of generation of air bubbles in the hydraulic oil causing cavitation by the operation of the hydraulic pump 13 is low. Thus, the processing at the above described Steps 4 to 6 is performed.

However, when it is determined to be "NO" at Step 3, in a low-temperature start state in which the temperature T of the coolant has lowered to the predetermined temperature Tw1 or less, the target rotational speed Nset of the engine 10 is higher than the pump cavitation limit rotational speed Nca. Therefore, if the hydraulic pump 13 is rotated/driven by the engine 10 in this state, it can be determined that the possibility of generation of air bubbles in the hydraulic oil and occurrence of cavitation is high. Thus, in the case of such low-temperature start, even if the engine 10 is started by the starter 28 at Step 8, the routine immediately moves to the subsequent Step 9, where such start control at the low temperature is stopped, and rotation of the starter 28 is forcedly stopped before start of the engine 10.

Therefore, in the processing at Steps 8 to 9, the engine 10 is not started, and the engine 10 can be kept in a stopped state. At the subsequent Step 10, the forced stop of start of the engine 10 is notified to the operator by the alarm device 37. That is, under the condition that the temperature T of the coolant has lowered to the predetermined temperature Tw1 or less, the fact that the target rotational speed Nset of the engine 10 is higher than the pump cavitation limit rotational speed Nca, and thus, start of the engine 10 was stopped for the purpose of preventing occurrence of cavitation is notified to the operator.

Thus, at the subsequent Step 7, when the operator performs "key OFF" of the start switch 29, the processing operation is finished. In this case, the operator is notified by the alarm device 37 that the target rotational speed Nset of the engine 10 should be lowered to a rotational speed equal to or less than the pump cavitation limit rotational speed Nca by using the rotational speed setting device 32.

Thus, when the operator performs "key ON" again at Step 1, the operator has already performed processing of lowering the target rotational speed Nset of the engine 10 to the pump cavitation limit rotational speed Nca or less. That is, the operator has rotated/operated the dial 32A of the rotational speed setting device 32 so as to lower it to a range equal to or less than the set value "ca" and equal to or more than "Lo". As a result, the target rotational speed Nset of the engine 10 has been set within the range from the low idling rotational speed NLo to the pump cavitation limit rotational speed Nca. Therefore, by performing selection control of the target rotational speed Nset on the characteristic line 38 indicated by a solid line in FIG. 5, the control processing at Steps 2 to 6 can be performed. As a result, occurrence of cavitation by the hydraulic oil can be suppressed even at the low-temperature start of the engine 10, and stable start control of the engine 10 can be realized.

Thus, according to the first embodiment, if the temperature T before the engine start (the temperature T of the coolant, for example) has lowered to the predetermined temperature Tw1 or less, it can be determined that cavitation can easily occur in the hydraulic oil sucked by the hydraulic pump 13 at start of the engine 10. Thus, the engine control device 36 stops the start of the engine 10 if the target rotational speed Nset of the engine 10 is above the characteristic line 39 indicated in FIG. 6 and within the range 39A indicated by hatching (that is, the range in which the temperature T of the coolant has lowered to the predetermined temperature Tw1 or less and also, the rotational speed is higher than the pump cavitation limit rotational speed Nca). As a result, occurrence of cavitation can be suppressed.

On the other hand, even under the low temperature condition in which the temperature T of the coolant has lowered to the predetermined temperature Tw1 or less, in the case the target rotational speed Nset of the engine 10 by the rotational speed setting device 32 has been lowered to the pump cavitation limit rotational speed Nca or less, even if the hydraulic pump 13 is rotated by starting the engine 10, the rotational speed of the hydraulic pump 13 can be kept low, and occurrence of cavitation can be suppressed. As a result, start control of the engine 10 under the low-temperature condition can be stably performed, and durability and a life of the hydraulic equipment can be improved.

It should be noted that, in the first embodiment, the processing at Step 2 shown in FIG. 7 is a specific example of the start temperature determining processing unit which is a constituent requirement of the present invention, and the processing at Steps 3 to 6 and Steps 8 to 10 shows a specific example of the start control processing unit.

Figure 8:
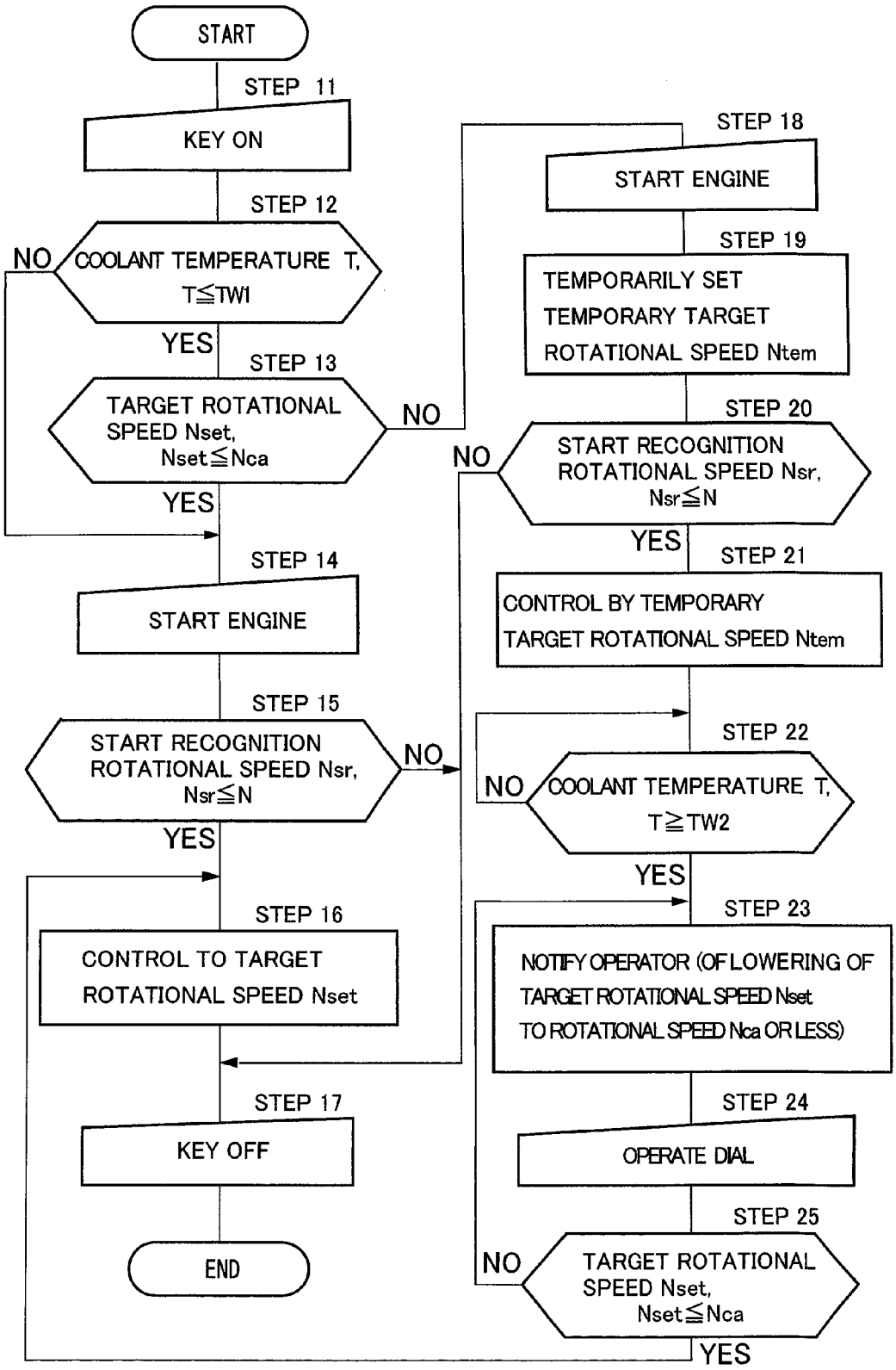
FIG. 8 is a flowchart showing the control processing at the start of the engine and after the start according to a second embodiment.

Next, FIG. 8 shows a second embodiment of the present invention. In the second embodiment, the component elements that are identical to those of the foregoing first embodiment will be simply denoted by the same reference numerals to avoid repetitions of similar explanations. However, a characteristic of the second embodiment is to control the rotational speed at the start of the engine 10 to be temporarily lowered to a temporary target rotational speed Ntem in a state in which the temperature T of the coolant has lowered to the predetermined temperature Tw1 or less, and also, if the target rotational speed Nset is higher than the pump cavitation limit rotational speed Nca.

In the second embodiment, assume that explanation will be made using an example in which, in the previous work using the hydraulic excavator 1, while the operator in the cab 8 rotates the dial 32A of the rotational speed setting device 32 to the position of the set value "Hi" indicated in FIG. 4, the engine 10 is stopped. As a result, if the engine 10 is to be newly started by the starter 28, it is presumed that the target rotational speed Nset of the engine 10 is set to the high idling rotational speed NHi shown in FIG. 5.

Here, the processing operation shown in FIG. 8 is started. Processing at Step 11 to Step 17 is performed similarly to Step 1 to Step 7 shown in FIG. 7 according to the above described first embodiment. Moreover, if it is determined to be "NO" at Step 13, the routine moves to Step 18, and the engine 10 is started similarly to Step 8 shown in FIG. 7. However, in the second embodiment, in processing at Step 19 subsequent to Step 18, the temporary target rotational speed Ntem is read out of the memory portion of the engine control device 36, and control of temporarily setting the temporary target rotational speed Ntem as a target rotational speed for engine start is performed. It is only necessary that the temporary target rotational speed Ntem is stored in advance in the memory portion of the engine control device 36 as a rotational speed equal to the pump cavitation limit rotational speed Nca (Ntem=Nca).

At Step 19 in FIG. 8, as described above, even if the target rotational speed Nset of the engine 10 is set to the high idling rotational speed NHi, the temporary target rotational speed Ntem (Ntem<NHi) taking its place is set as a temporary set value to temporarily replace the engine target rotational speed. Thus, the rotational speed control immediately after the start of the engine 10 by the starter 28 is performed in accordance with the temporary target rotational speed Ntem.

At the subsequent Step 20, it is determined whether or not the start rotational speed N of the engine 10 has reached the engine start recognition rotational speed Nsr, that is, equal to or more than the rotational speed Nsr. If it is determined to be "NO" at Step 20, the engine rotational speed N is lower than the start recognition rotational speed Nsr, and the engine 10 could not be started, and thus, the routine moves to Step 17 and waits for the operator to perform "key OFF" of the start switch 29.

If it is determined to be "YES" at Step 20, since the engine 10 could be started by the starter 28, the routine moves to the subsequent Step 21, and the rotational speed control of the engine 10 (that is, the fuel injection quantity control by the electronic governor 12) is performed so that the rotational speed N of the engine 10 becomes a rotational speed corresponding to the temporary target rotational speed Ntem. At the subsequent Step 22, it is determined whether or not the temperature T of the coolant has risen to a determination temperature Tw2 determined in advance or more.

This determination temperature Tw2 is set to a temperature equal to the above described predetermined temperature Tw1 or a temperature higher than that (Tw2=0° C., for example). That is, the determination temperature Tw2 is set by the following formula 2. While it is determined to be "NO" at Step 22, the rotational speed control of the engine 10 by the temporary target rotational speed Ntem is continued as a warming-up operation, and the routine waits for a rise of the temperature T of the coolant to the determination temperature Tw2 or more. If it is determined to be "YES" at Step 22, it can be determined that the warming-up operation of the engine 10 by the temporary target rotational speed Ntem is completed.

$$Tw2 \geq Tw1 \quad \text{[Formula 2]}$$

At the subsequent Step 23, alarm is given to the operator by the alarm device 37 so as to prompt the operator to perform an operation of lowering the dial 32A of the rotational speed setting device 32 to a position equal to or less than the set value "ca." and equal to or more than the set value "Lo" in FIG. 4. At Step 24, the routine waits for the operator to operate the dial 32A. As described above, at this stage, in the rotational speed setting device 32 in the cab 8, the dial 32A is still at the position of the set value "Hi" shown in FIG. 4, and the target rotational speed Nset of the engine 10 is still in the state set to the high idling rotational speed NHi shown in FIG. 5. That is, the temporary target rotational speed Ntem is used temporarily only after the start of the engine, and the target rotational speed Nset is returned to the set rotational speed by the dial 32A of the rotational speed setting device 32 after the start of the engine.

Thus, at the subsequent Step 25, it is determined whether or not the operator has performed the operation of lowering the dial 32A of the rotational speed setting device 32 from the position of the set value "Hi" to the position between "ca" and "Lo", that is, an operation of lowering the target rotational speed Nset of the engine 10 from the above described high idling rotational speed NHi to the rotational speed equal to or less than the pump cavitation limit rotational speed Nca. While it is determined to be "NO" at Step 25, the routine waits for the operator to perform a manual operation of the dial 32A, for example.

When it is determined to be "YES" at Step 25, the operator has performed the operation of lowering the target rotational speed Nset of the engine 10 to the rotational speed equal to or less than the pump cavitation limit rotational speed Nca in accordance with alarm contents of the alarm device 37, and thus, the routine moves to Step 16, and the engine control according to the target rotational speed Nset is performed. That is, the rotational speed N of the engine 10 returns to the rotational speed according to the target rotational speed Nset. As a result, at Step 16, the rotational speed control of the engine 10 (that is, the fuel injection quantity control by the electronic governor 12) is performed so that the rotational speed N of the engine 10 becomes the rotational speed corresponding to the target rotational speed Nset selected by the dial 32A of the rotational speed setting device 32.

The engine control processing at Step 16 as above is continued until the operator performs an operation of "key OFF" of the start switch 29 at Step 17 after that. Thus, by means of variable operation by the operator of the dial 32A of the rotational speed setting device 32 within the range of the set values "Lo" to "Hi", the operator can perform a desired work by using the hydraulic excavator. While the hydraulic excavator is operated as above, in the processing at Step 16, the target rotational speed Nset of the engine 10 can be variably controlled in a range from the low idling rotational speed NLo to the high idling rotational speed NHi, and the rotational speed control of the engine 10 according to work contents is performed.

Thus, in the second embodiment configured as above, too, occurrence of cavitation by the hydraulic oil at the low-temperature start of the engine 10 can be suppressed, and stable start control of the engine 10 can be realized similarly to the first embodiment. Particularly, the second embodiment is configured such that, in a state in which the temperature T of the coolant at start has lowered to the predetermined temperature Tw1 or less, and the target rotational speed Nset is higher than the pump cavitation limit rotational speed Nca, control that the target rotational speed of the engine 10 is temporarily replaced by the temporary target rotational speed Ntem for engine start is performed.

Thus, the start control of the engine 10 can be performed in accordance with the temporary set value lower than the set value of the rotational speed setting device 32 (that is, the temporary target rotational speed Ntem equal to the pump cavitation limit rotational speed Nca as an example), and rotation of the hydraulic pump 13 can be kept low, and occurrence of cavitation can be suppressed.

It should be noted that, in the second embodiment, the processing at Step 12 shown in FIG. 8 is a specific example of the start temperature determining processing unit which is a constituent requirement of the present invention, and the processing at Steps 13 to 16 and Steps 18 to 21 shows a specific example of the start control processing unit. Moreover, Step 22 shown in FIG. 8 is a specific example of the after-start temperature determining processing unit, and the processing at Steps 23 to 25 and Step 16 shows a specific example of the after-start rotational speed control processing unit.

Moreover, in the above described second embodiment, the case in which the temporary target rotational speed Ntem is set to a value equal to the pump cavitation limit rotational speed Nca is explained as an example. However, the present invention is not limited to that, and it may be so configured that the temporary target rotational speed Ntem may be selected as appropriate within a range from the low idling rotational speed NLo to the pump cavitation limit rotational speed Nca (that is, a range from NLo to Nca), and the temporary target rotational speed Ntem may be set to the low idling rotational speed NLo. That is, the temporary target rotational speed Ntem may be set to a target rotational speed lower than the pump cavitation limit rotational speed Nca and equal to or more than the low idling rotational speed NLo.

Next, FIGS. 9 to 12 show a third embodiment of the present invention. In the third embodiment, the component elements that are identical to those of the foregoing first embodiment will be simply denoted by the same reference numerals to avoid repetitions of similar explanations. However, a characteristic of the third embodiment is a configuration in which, in the after-start rotational speed control processing unit performed after the start of the engine 10, the rotational speed N of the engine 10 is automatically recovered gradually to a set value of the target rotational speed by the rotational speed setting device 32.

In the third embodiment, too, similarly to the above described second embodiment, a case in which, when the engine 10 is newly started by the starter 28, the dial 32A of the rotational speed setting device 32 is rotated to the position of the set value "Hi" will be described as an example. As a result, it is presumed that the target rotational speed Nset of the engine 10 is set to the high idling rotational speed NHi shown in FIG. 5.

Figure 9:
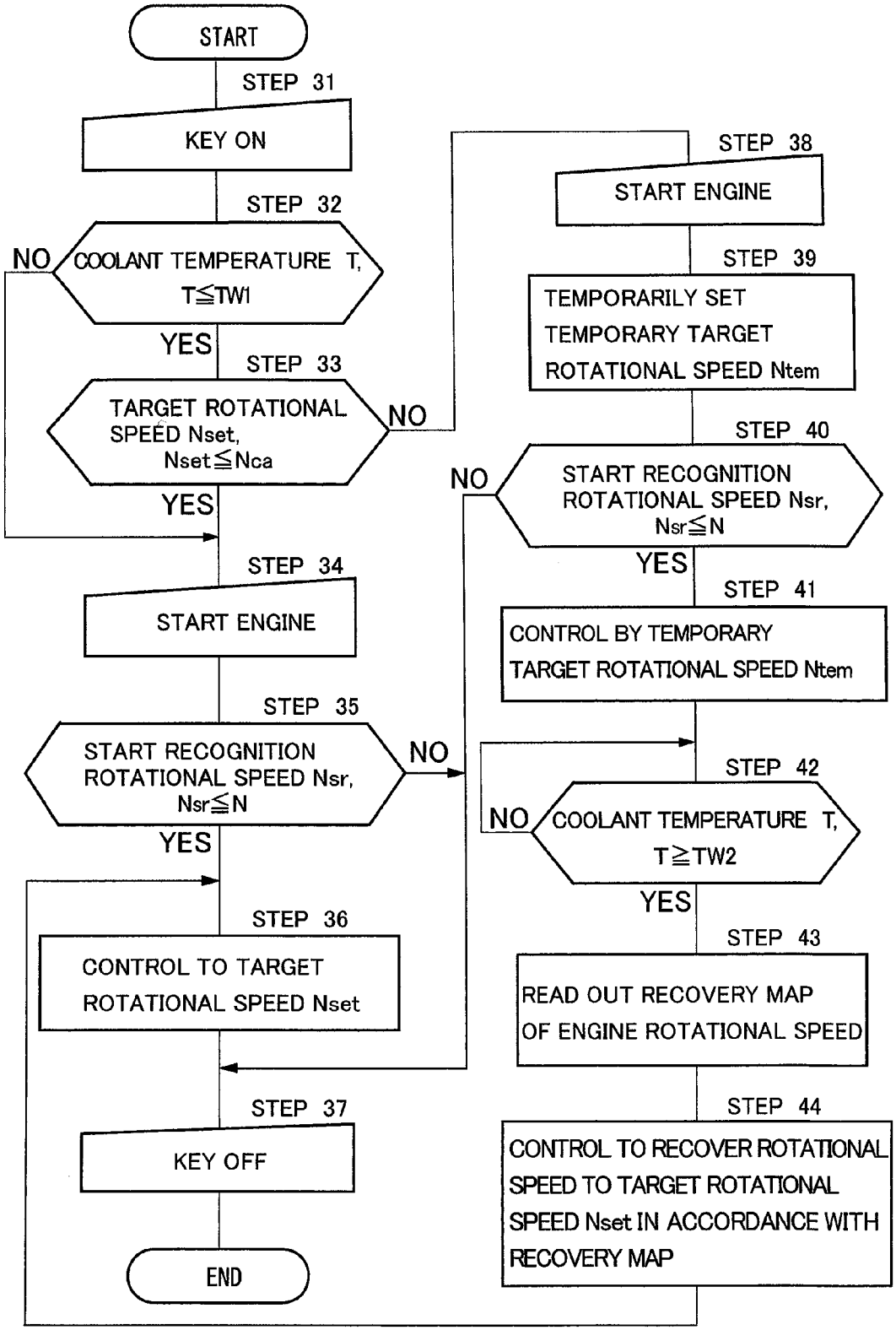
FIG. 9 is a flowchart showing the control processing at the start of the engine and after the start according to a third embodiment.

Here, the processing operation shown in FIG. 9 is started. The processing from Step 31 to Step 37 is performed similarly to Step 1 to Step 7 shown in FIG. 7 by the above described first embodiment. Moreover, if it is determined to be "NO" at Step 33, the routine moves to Step 38, and start of the engine 10 is performed similarly to Step 8 shown in FIG. 7. However, in the third embodiment, at the processing at Step 39 subsequent to Step 38, the temporary target rotational speed Ntem is read out of the memory portion of the engine control device 36, and the temporary target rotational speed Ntem is temporarily set as a target rotational speed for engine start. It is only necessary that the temporary target rotational speed Ntem is stored in advance in the memory portion of the engine control device 36 as a rotational speed equal to the pump cavitation limit rotational speed Nca (Ntem=Nca).

At Step 39 in FIG. 9, as described above, even if the target rotational speed Nset of the engine 10 is set to the high idling rotational speed NHi, the temporary target rotational speed Ntem replacing that (Ntem<NHi) is temporarily replaced the engine target rotational speed. Thus, the rotational speed control after the start of the engine 10 by the starter 28 is performed in accordance with the temporary target rotational speed Ntem.

At the subsequent Step 40, it is determined whether or not the start rotational speed N of the engine 10 has reached the engine start recognition rotational speed Nsr, that is, equal to or more than the rotational speed Nsr. If it is determined to be "NO" at Step 40, since the engine 10 cannot be started, the routine moves to Step 37 and waits for the operator to perform "key OFF" of the start switch 29.

If it is determined to be "YES" at Step 40, it means that the engine 10 could be started by the starter 28 and thus, the rotational speed control of the engine 10 (that is, the fuel injection quantity control by the electronic governor 12) is performed so that the rotational speed N of the engine 10 becomes a rotational speed corresponding to the temporary target rotational speed Ntem by the processing at the subsequent Step 41. At the subsequent Step 42, it is determined whether or not the temperature T of the coolant has risen to the determination temperature Tw2 (Tw2=0° C., for example) determined in advance or more.

While it is determined to be "NO" at Step 42, the rotational speed control of the engine 10 is continued as the warming-up operation by the temporary target rotational speed Ntem, whereby the routine waits for the temperature T of the coolant to rise to the determination temperature Tw2 or more. If it is determined to be "YES" at Step 42, it can be determined that the warming-up operation of the engine 10 by the temporary target rotational speed Ntem is completed.

Figure 12:
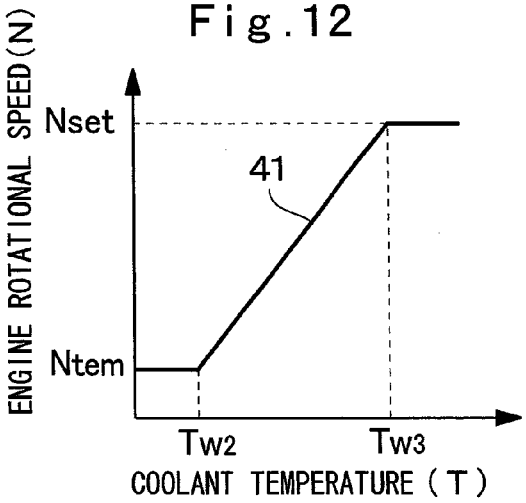
FIG. 12 is a characteristic line diagram of a recovery map in which the engine rotational speed is gradually increased in accordance with a temperature of the coolant after the start of the engine.

Thus, at the subsequent Step 43, a recovery map of the engine rotational speed shown in FIG. 12 is read out, for example. In the recovery map shown in FIG. 12, the rotational speed N of the engine 10 is gradually increased from the temporary target rotational speed Ntem to the target rotational speed Nset until the temperature T of the coolant reaches a temperature Tw3 (Tw3>Tw2) to be a target from the determination temperature Tw2 along a characteristic line 41. At the subsequent Step 44, control of automatically recovering the rotational speed N of the engine 10 to the target rotational speed Nset according to the set value by the dial 32A of the rotational speed setting device 32 on the basis of the recovery map shown in FIG. 12 is performed. By this automatic recovery control, the rotational speed N of the engine 10 is gradually increased from the temporary target rotational speed Ntem to the target rotational speed Nset until the temperature T of the coolant reaches the temperature Tw3 (Tw3>Tw2) to be a target from the determination temperature Tw2 along the characteristic line 41 shown in FIG. 12, and rapid fluctuation of the engine rotational speed can be suppressed.

Here, a case in which the automatic recovery control is performed along a characteristic line 42 shown in FIG. 10 and a characteristic line 42A shown in FIG. 11 will be described by using a specific example. That is, if the dial 32A of the rotational speed setting device 32 is at the position of the set value "Hi" shown in FIG. 4 as described above, and the target rotational speed Nset is set to the high idling rotational speed NHi as the characteristic line 42 indicated by a dot line in FIG. 10, the automatic recovery control is performed as the characteristic line 42A indicated by a dot line in FIG. 11.

Figure 11:
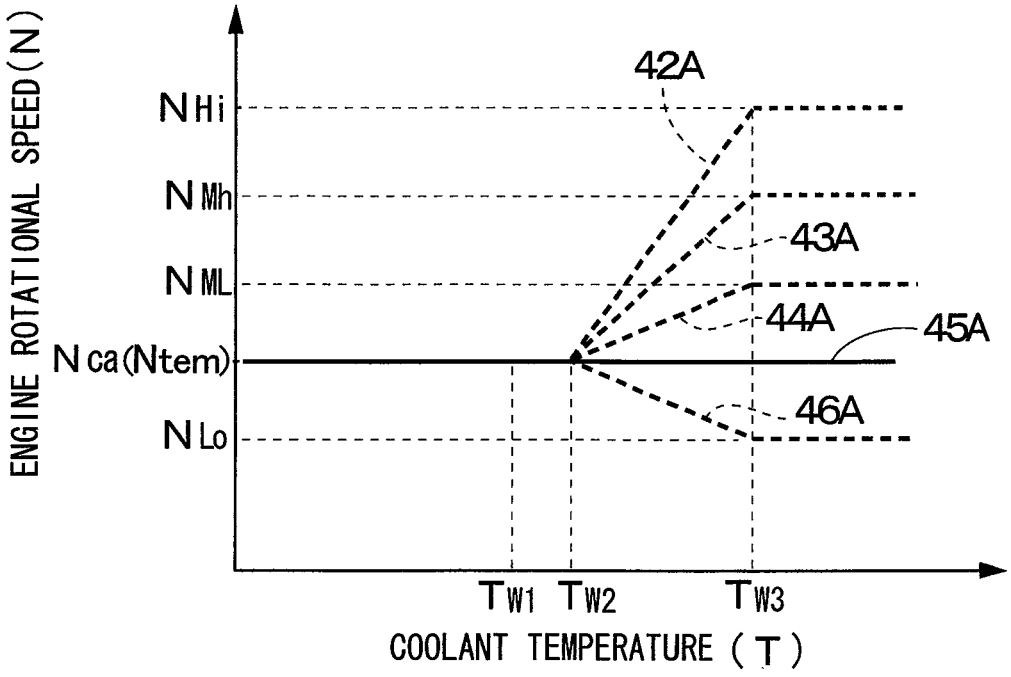
FIG. 11 is a characteristic line diagram showing a relationship between the coolant temperature and the engine rotational speed at start of the engine and after the start.

That is, in case the automatic recovery control along the characteristic line 42A in FIG. 11 is to be performed at Step 44, until the temperature T of the coolant reaches the temperature Tw3 to be a target from the determination temperature Tw2, the rotational speed N of the engine 10 is gradually increased from the temporary target rotational speed Ntem to the high idling rotational speed NHi which is the target rotational speed Nset. When the temperature T of the coolant reaches the temperature Tw3 to be a target, the routine moves to the subsequent Step 36, and control for maintaining the rotational speed N of the engine 10 at the high idling rotational speed NHi which is the target rotational speed Nset. At this Step 36, the rotational speed control of the engine 10 is performed so that the rotational speed N of the engine 10 becomes the rotational speed corresponding to the target rotational speed Nset selected by the rotational speed setting device 32. Such engine control processing at Step 36 is continued until the operator performs "key OFF" of the start switch 29 at Step 37 after that.

It should be noted that, in the above described third embodiment, the case in which, when the engine 10 is newly started, the dial 32A of the rotational speed setting device 32 is rotated to the position of the set value "Hi", the target rotational speed Nset of the engine 10 is set to the high idling rotational speed NHi is described as an example. However, the automatic recovery control by the present invention is not limited to that, and the automatic recovery control may be performed along characteristic lines 43 and 44 other than the characteristic line 42 shown in FIG. 10, for example.

That is, when the engine 10 is newly started, the dial 32A of the rotational speed setting device 32 might have been rotated to a position of a set value "Mh" of medium- to high-speed rotation exemplified in FIG. 4. As a result, the target rotational speed Nset of the engine 10 is set to a rotational speed NMh at a medium- to high-speed lower than the high idling rotational speed NHi as the characteristic line 43 indicated by a dot line in FIG. 10. In such a case, the automatic recovery control as a characteristic line 43A indicated by a dot line in FIG. 11 is performed.

That is, if the automatic recovery control along the characteristic line 43A in FIG. 11 is performed at Step 44, until the temperature T of the coolant reaches the temperature Tw3 to be a target from the determination temperature Tw2, the rotational speed N of the engine 10 is gradually increased from the temporary target rotational speed Ntem to the rotational speed NMh which is the target rotational speed Nset. When the temperature T of the coolant reaches the temperature Tw3 to be a target, the routine moves to the subsequent Step 36, and the rotational speed N of the engine 10 is controlled in accordance with the rotational speed NMh which is the target rotational speed Nset. In this processing at Step 36, the rotational speed control of the engine 10 is performed such that, if the operator changes the set value of the target rotational speed Nset by the rotational speed setting device 32, the rotational speed N of the engine 10 becomes a rotational speed corresponding to the target rotational speed Nset set by the rotational speed setting device 32.

On the other hand, the dial 32A of the rotational speed setting device 32 might have been rotated to the position of the set value "ML" of medium- to low-speed rotation exemplified in FIG. 4. As a result, the target rotational speed Nset of the engine 10 is set to a medium- to low-speed rotational speed NML lower than the rotational speed NMh as a characteristic line 44 indicated by a dot line in FIG. 10 (however, NMh>NML>Nca). In such a case, the automatic recovery control along a characteristic line 44A indicated by a dot line in FIG. 11 is performed at Step 44. That is, until the temperature T of the coolant reaches the temperature Tw3 to be a target from the determination temperature Tw2, the rotational speed N of the engine 10 is gradually increased from the temporary target rotational speed Ntem to the rotational speed NML which is the target rotational speed Nset. When the temperature T of the coolant reaches the temperature Tw3 to be a target, the rotational speed N of the engine 10 is controlled in accordance with the rotational speed NML which is the target rotational speed Nset by the processing at Step 36.

Figure 10:
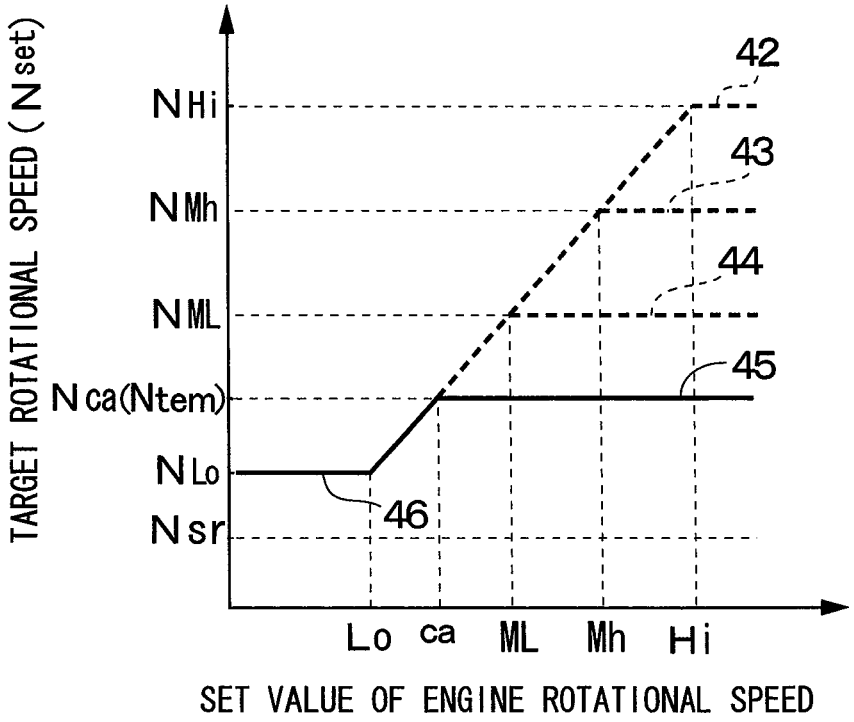
FIG. 10 is a characteristic line diagram showing a relationship between the set value of the engine rotational speed by the rotational speed setting device and the target rotational speed.

Further, in case the dial 32A of the rotational speed setting device 32 is at the position of the set value "ca" exemplified in FIG. 4, and the target rotational speed Nset is set to the pump cavitation limit rotational speed Nca as a characteristic line 45 indicated by a solid line in FIG. 10 (however, NML>Nca>NLo), since it is determined to be "YES" at Step 33, control along a characteristic line 45A indicated by a solid line in FIG. 11 is performed in the processing at the subsequent Steps 34 to 36. In this case, even if the temperature T of the coolant rises from the determination temperature Tw2 to the temperature Tw3 or more, the rotational speed N of the engine 10 is maintained at the pump cavitation limit rotational speed Nca which is the target rotational speed Nset.

When the temperature T of the coolant reaches the temperature Tw3 to be a target, the rotational speed N of the engine 10 is controlled in accordance with the pump cavitation limit rotational speed Nca which is the target rotational speed Nset by the processing at Step 36. In this case, too, if the operator changes the set value of the target rotational speed Nset by the rotational speed setting device 32 in the processing at Step 36, the rotational speed control of the engine 10 is performed so that the rotational speed N of the engine 10 becomes a rotational speed corresponding to the target rotational speed Nset set by the rotational speed setting device 32.

Moreover, in case the dial 32A of the rotational speed setting device 32 is at the position of the set value "Lo" exemplified in FIG. 4 and the target rotational speed Nset is set to the low idling rotational speed NLo as a characteristic line 46 indicated by a solid line in FIG. 10, too, since it is determined to be "YES" at Step 33, the processing at the subsequent Steps 34 to 36 is performed. However, if the processing at Steps 38 to 44 is performed, control along a characteristic line 46A indicated by a dot line in FIG. 11 is performed. That is, until the temperature T of the coolant reaches the temperature Tw3 to be a target from the determination temperature Tw2, the rotational speed N of the engine 10 is gradually lowered from the temporary target rotational speed Ntem to the low idling rotational speed NLo which is the target rotational speed Nset. When the temperature T of the coolant reaches the temperature Tw3 to be a target, the rotational speed N of the engine 10 is controlled in accordance with the low idling rotational speed NLo which is the target rotational speed Nset by the processing at Step 36.

Thus, in the third embodiment configured as above, too, occurrence of cavitation can be suppressed at low-temperature start of the engine 10, and stable start control of the engine 10 can be realized similarly to the first embodiment. Particularly, in the third embodiment, after the start of the engine 10, the rotational speed N of the engine 10 is configured to be automatically recovered gradually to the set value of the engine rotational speed by the rotational speed setting device 32.

As a result, even if a difference between the temporary set value of the set value and the rotational speed setting device 32 (that is, a rotational speed difference) is large after the start of the engine 10, by automatically recovering the rotational speed N of the engine 10 gradually, rapid fluctuation of the engine rotational speed N can be prevented, whereby also occurrence of cavitation can be suppressed. After that, engine control can be performed by the rotational speed according to the manual operation of the operator.

It should be noted that, in the above described third embodiment, the processing at Step 32 shown in FIG. 9 is a specific example of the start temperature determining processing unit which is a constituent requirement of the present invention, and the processing at Steps 33 to 36 and Steps 38 to 41 shows a specific example of the start control processing unit. Moreover, the processing at Step 42 is a specific example of the after-start temperature determining processing unit, and the processing at Steps 43 and 44 shows a specific example of the after-start rotational speed control processing unit.

Figure 13:
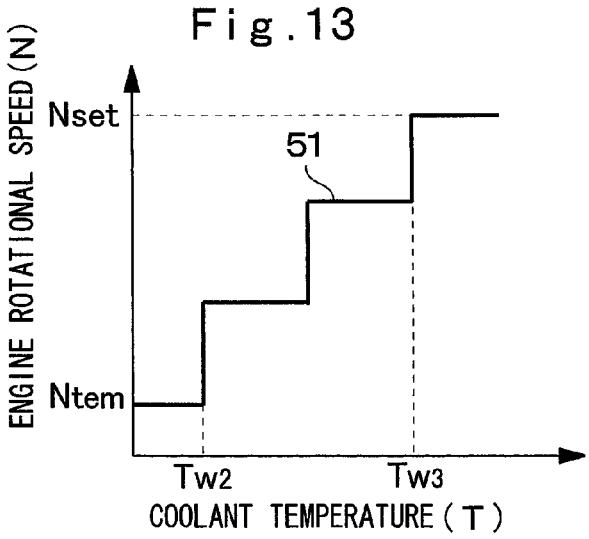
FIG. 13 is a characteristic line diagram of the recovery map in which the engine rotational speed is increased in steps in accordance with the temperature of the coolant after the start of the engine according to a first variation.
Figure 14:
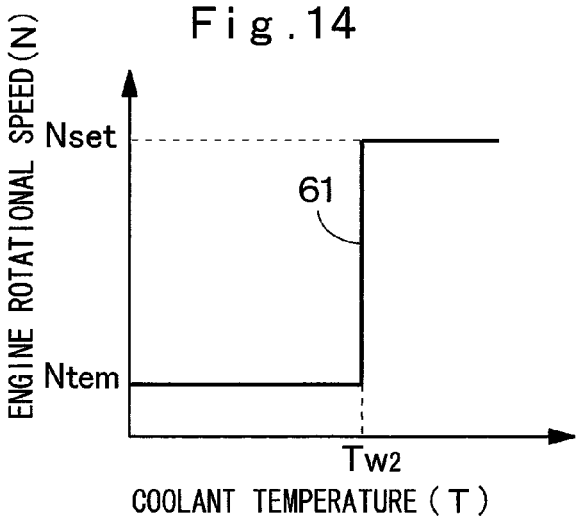
FIG. 14 is a characteristic line diagram of the recovery map in which the engine rotational speed is increased in accordance with the temperature of the coolant after the start of the engine according to a second variation.

In addition, in the above described third embodiment, the case in which the automatic recovery control performed after the start of the engine 10 is performed along the characteristic line 41 in the recovery map shown in FIG. 12 is described as an example. However, the present invention is not limited to that, and as in the recovery map according to a first variation shown in FIG. 13, for example, the automatic recovery control may be configured to be performed so that the rotational speed N of the engine 10 is increased in steps from the temporary target rotational speed Ntem to the target rotational speed Nset along a characteristic line 51 until the temperature T of the coolant reaches the temperature Tw3 to be a target from the determination temperature Tw2. Moreover, as in the recovery map according to a second variation shown in FIG. 14, for example, the automatic recovery control may be configured to be performed so that the rotational speed N of the engine 10 is increased from the temporary target rotational speed Ntem to the target rotational speed Nset along a characteristic line 61.

Figure 15:
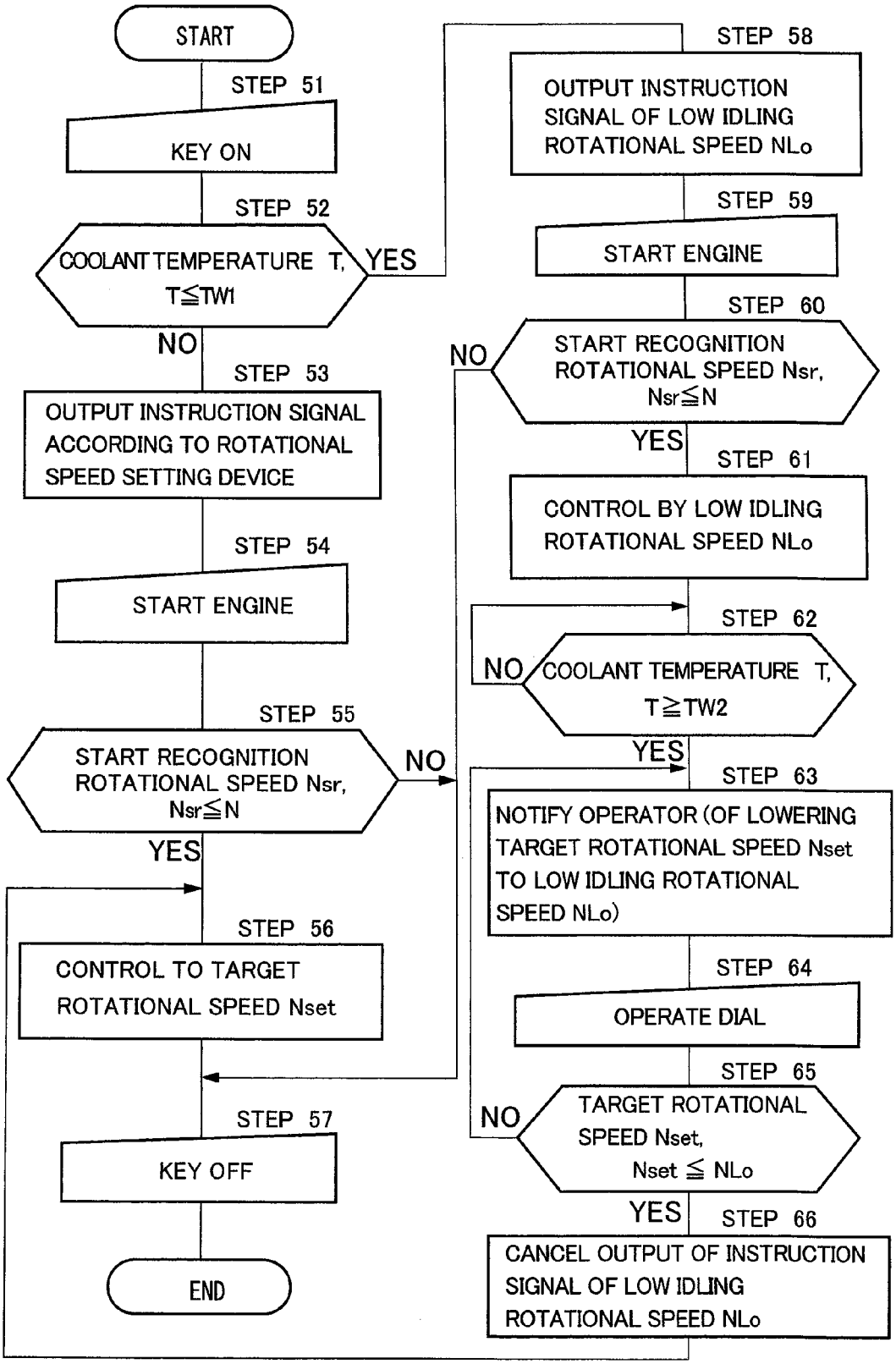
FIG. 15 is a flowchart showing control processing at the engine start and after the start according to a fourth embodiment.

Next, FIG. 15 shows a fourth embodiment of the present invention. In the fourth embodiment, the component elements that are identical to those of the foregoing first embodiment will be simply denoted by the same reference numerals to avoid repetitions of similar explanations. However, a characteristic of the fourth embodiment is a configuration in which start control of the engine 10 is performed by forcedly lowering the target rotational speed to the low idling rotational speed NLo at low-temperature start of the engine 10.

In the fourth embodiment, too, similarly to the above described second embodiment, a case in which, when the engine 10 is newly started by the starter 28, the dial 32A of the rotational speed setting device 32 has been rotated to the position of the set value "Hi" will be described as an example. As a result, it is presumed that the target rotational speed Nset of the engine 10 is set to the high idling rotational speed NHi shown in FIG. 5.

Here, the processing operation shown in FIG. 15 is started. Processing at Steps 51 and 52 is performed similarly to Steps 1 and 2 shown in FIG. 7 by the above described first embodiment. If it is determined to be "NO" at Step 52, since the temperature T of the coolant at start of the engine 10 is higher than the predetermined temperature Tw1, it can be determined that there is no concern of occurrence of cavitation even if the hydraulic oil is stirred by the hydraulic pump 13 with start of the engine 10.

Thus, in this case, the routine moves to Step 53, and an instruction signal (set value) of the target rotational speed Nset selected by the rotational speed setting device 32 is outputted as it is. At the subsequent Step 54, the engine 10 is started by operating the starter 28. Processing at the subsequent Steps 55 to 57 is performed similarly to Steps 5 to 7 shown in FIG. 7 by the first embodiment. As a result, the operation control of the engine 10 is performed at the rotational speed N corresponding to the target rotational speed Nset by the rotational speed setting device 32.

However, if it is determined to be "YES" at Step 52, the temperature T of the coolant is the predetermined temperature Tw1 or less, and low-temperature start of the engine 10 is to be performed. Thus, at the subsequent Step 58, regardless of the set value of the rotational speed setting device 32, an instruction signal of the low idling rotational speed NLo is outputted as a fixed set value which is temporarily fixed (that is, it is also a temporary set value) so that the target rotational speed Nset at the low-temperature start of the engine 10 becomes a temporary target rotational speed corresponding to the low idling rotational speed NLo.

At the subsequent Step 59, in a state in which the target rotational speed Nset is temporarily set to the low idling rotational speed NLo corresponding to the fixed set value, the engine 10 is started by the starter 28. Processing at the subsequent Step 60 is performed similarly to Step 20 shown in FIG. 8 by the above described second embodiment. At the subsequent Step 61, operation control of the engine 10 is performed so that the rotational speed N after the start of the engine 10 becomes a rotational speed corresponding to the low idling rotational speed NLo. As a result, at the low-temperature start of the engine 10, the rotational speed control of the engine 10 (that is, the fuel injection quantity control by the electronic governor 12) is performed at the low idling rotational speed NLo lower than the pump cavitation limit rotational speed Nca.

Thus, the rotational speed of the engine 10 at the low-temperature start of the engine 10 can be prevented from becoming a rotational speed higher than the pump cavitation limit rotational speed Nca, and the rotational speed of the hydraulic pump 13 is kept low, and generation of air bubbles and cavitation in the hydraulic oil can be prevented. After the start of the engine 10, it is determined whether or not the temperature T of the coolant has risen to the determination temperature Tw2 determined in advance or more at the subsequent Step 62.

This determination temperature Tw2 is set to a temperature equal to the above described predetermined temperature Tw1 or a temperature higher than that (Tw2=0° C., for example). While it is determined to be "NO" at Step 62, the rotational speed control of the engine 10 by the temporary target rotational speed (that is, the low idling rotational speed NLo) is continued as a warming-up operation, and rise of the temperature T of the coolant to the determination temperature Tw2 or more is awaited. If it is determined to be "YES" at Step 62, it can be determined that the warming-up operation of the engine 10 by the low idling rotational speed NLo is completed.

At the subsequent Step 63, an alarm is given to the operator by the alarm device 37 so as to prompt the operator to perform a changing operation of lowering the dial 32A of the rotational speed setting device 32 to the position of the set value "Lo" shown in FIG. 4. That is, until the operator performs the changing operation of the dial 32A, as described above, the target rotational speed Nset of the engine 10 is kept being set to the high idling rotational speed NHi. Thus, at Step 64, the operator's operation of the dial 32A is awaited. At the subsequent Step 65, it is determined whether or not the operator has performed the operation of lowering the dial 32A of the rotational speed setting device 32 to the position of the set value "Lo", that is, whether or not the operation of lowering the target rotational speed Nset of the engine 10 to the low idling rotational speed NLo has been performed. While it is determined to be "NO" at Step 65, the operator's manual changing operation of the dial 32A is awaited, for example.

If it is determined to be "YES" at Step 65, since the operator has performed the operation of lowering the target rotational speed Nset of the engine 10 to a rotational speed lower than the pump cavitation limit rotational speed Nca (that is, the low idling rotational speed NLo) in accordance with the alarm contents of the alarm device 37, the routine moves to Step 66, and control of cancelling the operation at the low idling rotational speed NLo is performed.

Thus, the target rotational speed Nset of the engine 10 is lowered to a rotational speed corresponding to the low idling rotational speed NLo, and also, in a state in which such control is cancelled, the routine returns to the processing at Step 56. As a result, the operator in the cab 8 can raise the set value by the dial 32A of the rotational speed setting device 32 from the position of "Lo" to an arbitrary set value toward the position of "Hi".

That is, in the control processing at Step 56, the rotational speed control of the engine 10 can be performed so that the rotational speed N of the engine 10 becomes a rotational speed corresponding to the target rotational speed Nset selected by the rotational speed setting device 32. That is, if the operator variably operates the dial 32A of the rotational speed setting device 32 within a range of the set values "Lo" to "Hi", the target rotational speed Nset of the engine 10 can be variably controlled within the range from the low idling rotational speed NLo to the high idling rotational speed NHi, and the rotational speed control of the engine 10 according to work contents is performed.

Thus, in the fourth embodiment configured as above, too, occurrence of cavitation can be suppressed at the low-temperature start of the engine 10, and stable start control of the engine 10 can be realized similarly to the first embodiment. Particularly, in the fourth embodiment, it is configured such that control of temporarily replacing the target rotational speed of the engine 10 by the temporary target rotational speed by the fixed set value for engine start (that is, the low idling rotational speed NLo) is performed if the temperature T of the coolant at start is lowered to the predetermined temperature Tw1 or less.

As a result, start control of the engine 10 can be performed in accordance with the fixed set value (that is, the low idling rotational speed NLo) lower than the set value of the rotational speed setting device 32, and thus, rotation of the hydraulic pump 13 is kept low, and occurrence of cavitation can be suppressed. Moreover, if viscosity of the hydraulic oil lowers with the temperature rise after engine start and it becomes less likely that cavitation occurs, the control of the engine rotational speed by the fixed set value can be cancelled.

Moreover, the control of the engine rotational speed by the fixed set value can be continued until the operator changes the set value of the rotational speed setting device 32 to a value corresponding to the low idling rotational speed after the start of the engine 10, and if the operator performs the changing operation, the control of the engine rotational speed by the fixed set value can be cancelled. Therefore, the engine control can be variably performed by the rotational speed according to the manual operation of the operator after that (that is, within the range from the low idling rotational speed NLo to the high idling rotational speed NHi).

It should be noted that, in the above described forth embodiment, the processing at Step 52 shown in FIG. 15 is a specific example of the start temperature determining processing unit which is a constituent requirement of the present invention, and Steps 58 to 61 show a specific example of the start control processing unit. Moreover, the processing at Step 62 is a specific example of the after-start temperature determining processing unit, and the processing at Steps 63 to 66 and Step 56 shows a specific example of the after-start rotational speed control processing unit.

In addition, in each of the above described embodiments, the case in which the water temperature sensor 30 is used as the temperature state detector for detecting the temperature state of the engine 10 is described as an example. However, the present invention is not limited to that, and a temperature sensor for detecting an intake air temperature of the engine 10, a temperature sensor of an engine oil, a temperature sensor for detecting an oil temperature of the hydraulic oil or a temperature sensor for detecting an ambient temperature (outside air temperature) at a position in the vicinity of the engine 10 can be used so as to constitute the temperature state detector for detecting the temperature state of the engine 10, for example.

Moreover, input/output of a signal with respect to the vehicle body control device 35 and the engine control device 36 of the control device 34 may be configured to be made by using means such as CAN communication or the like as a serial communication portion for conducting multiplex communication for onboard equipment mounted on the upper revolving structure 4 (vehicle body).

Furthermore, in each of the above described embodiments, the small-sized hydraulic excavator 1 on which an electronically controlled engine is mounted is described as an example. However, the construction machine on which the electronically controlled engine according to the present invention is mounted is not limited to that, and the present invention may be also applied to a medium-sized or larger hydraulic excavator, for example. Moreover, the present invention can be widely applied also to construction machines such as a hydraulic excavator provided with a wheel-type lower traveling structure, a wheel loader, a forklift, a hydraulic crane and the like.

DESCRIPTION OF REFERENCE NUMERALS

1: Hydraulic excavator (Construction machine)
2: Lower traveling structure (Vehicle body)
4: Upper revolving structure (Vehicle body)
5: Working mechanism
6: Revolving frame (Frame)
9: Counterweight
10: Engine
11: Exhaust pipe
12: Electronic governor (Electronically controlled fuel injection device)
13: Hydraulic pump
15: Heat exchanger
16: Exhaust gas purifying device
24: Hydraulic actuator
25: Control valve
26: Pilot pump
27: Pilot operating valve
27A: Operating lever
28: Starter
29: Start switch
30: Water temperature sensor (Temperature state detector)
31: Rotation detector
32: Rotational speed setting device
34: Control device
35: Vehicle body control device
36: Engine control device
37: Alarm device
Nca: Pump cavitation limit rotational speed (Threshold value)
Nsr: Engine start recognition rotational speed
Ntem: Temporary target rotational speed (temporary set value)
NHi: High idling rotational speed
NLo: Low idling rotational speed
Tw1: Predetermined temperature
Tw2: Determination temperature

The invention claimed is:

1. A construction machine comprising:

an engine (10) to which injection fuel is supplied by an electronically controlled fuel injection device (12);

a temperature state detector (30) for detecting a temperature state of said engine (10);

a rotation detector (31) for detecting a rotational speed (N) of said engine (10);

a rotational speed setting device (32) for setting a target rotational speed (Nset) of said engine (10);

a control device (34) for driving/controlling said engine (10) on the basis of signals from said temperature state detector (30), said rotation detector (31), and said rotational speed setting device (32);

a variable displacement type hydraulic pump (13) which is driven by said engine (10) so as to deliver pressurized oil and is subjected to torque limitation control; and a hydraulic actuator (24) driven by the pressurized oil delivered from said hydraulic pump (13), characterized in that:

said control device (34) includes;

a start temperature determining processing unit configured to determine whether or not a temperature (T) at start of said engine (10) has lowered to a predetermined temperature (Tw1) determined in advance on the basis of a detection signal outputted from said temperature state detector (30);

a start control processing unit configured to perform start control of said engine (10) in accordance with a set value of said target rotational speed (Nset) by said rotational speed setting device (32) when it is determined by the start temperature determining processing unit that said temperature (T) is equal to or lower than said predetermined temperature (Tw1);

a pump cavitation limit rotational speed as a limit value at which possibility of generation of air bubbles in the hydraulic oil and of occurrence of cavitation becomes higher when said hydraulic pump (13) rotates at a low-temperature start of said engine is determined in advance as a threshold value (Nca);

in case the set value of said target rotational speed (Nset) by said rotational speed setting device (32) is equal to or less than said threshold value (Nca), said start control processing unit starts said engine (10) in accordance with the set value at this time; and in case the set value of said rotational speed setting device (32) is higher than said threshold value (Nca), said start control processing unit stops the start of said engine (10) or performs the start control of said engine (10) in accordance with a temporary set value (Ntem) for engine start set in advance.

2. The construction machine according to claim 1, wherein said temporary set value (Ntem) is set in advance to a value lower than a set value of said rotational speed setting device (32) and equal to or lower than said threshold value (Nca).

3. The construction machine according to claim 1, wherein said control device (34) includes:

an after-start temperature determining processing unit configured to determine whether or not said temperature (T) of said engine (10) has risen to a determination temperature (Tw2) equal to or higher than said predetermined temperature (Tw1) by a detection signal from said temperature state detector (30) after the start of said engine (10); and an after-start rotational speed control processing unit configured to control said rotational speed (N) of said engine (10) in accordance with the set value of said target rotational speed (Nset) by said rotational speed setting device (32) when it is determined by the after-start temperature determining processing unit that said temperature (T) has risen to said determination temperature (Tw2).

4. The construction machine according to claim 3, wherein said after-start rotational speed control processing unit is configured such that, when it is determined by said after-start temperature determining processing unit that said temperature (T) has risen to said determination temperature (Tw2), said rotational speed (N) of said engine (10)

is automatically recovered in accordance with the set value of said target rotational speed (Nset) by said rotational speed setting device (32).

5. The construction machine according to claim 1, wherein said start control processing unit of said control device (34) is configured such that, when said temperature (T) is determined by said start temperature determining processing unit to be equal to or lower than said predetermined temperature (Tw1), the set value of said target rotational speed (Nset) by said rotational speed setting device (32) is temporarily fixed to a value corresponding to a low idling rotational speed (NLo) which is said temporary set value (Ntem), and said engine (10) is subjected to start control in accordance with this fixed set value, and said control device (34) comprises:

an after-start temperature determining processing unit configured to determine whether or not said temperature (T) of said engine (10) has risen to a determination temperature (Tw2) equal to or higher than said predetermined temperature (Tw1) by the detection signal from said temperature state detector (30) after the start of said engine (10); and an after-start rotational speed control processing unit configured to cancel control of said target rotational speed (Nset) by said fixed set value when it is determined by the after-start temperature determining processing unit that said temperature (T) has risen to said determination temperature (Tw2).

6. The construction machine according to claim 5, wherein said after-start rotational speed control processing unit is configured such that, when said after-start temperature determining processing unit determines that said temperature (T) has risen to said determination temperature (Tw2), the control of said target rotational speed (Nset) by said fixed set value is continued until an operator changes the set value of said rotational speed setting device (32) to a value corresponding to said low idling rotational speed (NLo), and the control of said target rotational speed (Nset) by said fixed set value is cancelled in response to the changing operation by the operator.

7. The construction machine according to claim 5, wherein said after-start rotational speed control processing unit is configured to control said rotational speed (N) of said engine (10) in accordance with a set value of said target rotational speed (Nset) by said rotational speed setting device (32) at the time of cancelling the control of said target rotational speed (Nset) by said fixed set value.

* * * * *